US009322208B2

(12) United States Patent
Matta

(10) Patent No.: US 9,322,208 B2
(45) Date of Patent: Apr. 26, 2016

(54) WINDOW REVEAL SYSTEMS AND METHODS

(71) Applicant: Perfect Window Reveal, LLC, Covina, CA (US)

(72) Inventor: Greg Matta, Las Vegas, NV (US)

(73) Assignee: Perfect Window Reveal, LLC, Covina, CA (US)

( * ) Notice: Subject to any disclaimer, the term of this patent is extended or adjusted under 35 U.S.C. 154(b) by 0 days.

(21) Appl. No.: 14/462,512

(22) Filed: Aug. 18, 2014

(65) Prior Publication Data

US 2014/0352240 A1 Dec. 4, 2014

Related U.S. Application Data

(63) Continuation of application No. 12/793,536, filed on Jun. 3, 2010, now Pat. No. 8,826,612.

(51) Int. Cl.

| | |
|---|---|
| ***E06B 3/00*** | (2006.01) |
| ***E06B 1/34*** | (2006.01) |
| ***E06B 1/60*** | (2006.01) |
| ***E06B 9/17*** | (2006.01) |
| ***E06B 9/42*** | (2006.01) |
| ***E04B 1/66*** | (2006.01) |
| ***E06B 1/62*** | (2006.01) |
| ***E06B 1/36*** | (2006.01) |
| ***E06B 1/58*** | (2006.01) |
| *E06B 1/06* | (2006.01) |
| *E06B 9/68* | (2006.01) |

(52) U.S. Cl.

CPC . *E06B 1/342* (2013.01); *E04B 1/66* (2013.01); *E06B 1/36* (2013.01); *E06B 1/58* (2013.01); *E06B 1/60* (2013.01); *E06B 1/6015* (2013.01); *E06B 1/62* (2013.01); *E06B 9/17015* (2013.01); *E06B 9/42* (2013.01); *E06B 1/06* (2013.01); *E06B 9/68* (2013.01)

(58) Field of Classification Search

CPC ..... E06B 1/342; E06B 1/58; E06B 1/6015; E06B 1/36; E06B 1/66; E06B 1/62; E06B 1/06

USPC ..... 160/241, 26, 27, 33; 52/208, 786.11

See application file for complete search history.

(56) References Cited

U.S. PATENT DOCUMENTS

| | | | | | |
|---|---|---|---|---|---|
| 1,393,792 | A | * | 10/1921 | Knapp | 52/204.53 |
| 2,235,295 | A | * | 3/1941 | Morgan | 160/267.1 |
| 2,530,218 | A | * | 11/1950 | Barrows | 160/98 |
| 2,606,607 | A | * | 8/1952 | Lawrence | 160/27 |
| 3,238,679 | A | * | 3/1966 | Capoccia | 52/204.55 |
| 4,359,079 | A | * | 11/1982 | Bledsoe | 160/26 |
| 4,369,829 | A | * | 1/1983 | Casiday | 160/120 |
| 4,398,585 | A | * | 8/1983 | Marlow | 160/23.1 |
| 4,649,980 | A | * | 3/1987 | Kunz | 160/98 |
| 4,763,455 | A | * | 8/1988 | Schneller | 52/255 |
| 4,912,899 | A | * | 4/1990 | Plasker et al. | 52/241 |

(Continued)

*Primary Examiner* — Brian Glessner
*Assistant Examiner* — Paola Agudelo
(74) *Attorney, Agent, or Firm* — Brian T. Duke; Nixon Peabody LLP

(57) ABSTRACT

A window reveal kit can include a window, a first connector, and at least one reveal trim. The window has an outer side, an inner side, and a frame portion about a perimeter of the window. The first connector can be formed on the frame portion, on the inner side of the window. The at least one reveal trim can have a second connector that is configured to engage the first connector so that the reveal trim extends from the first connector.

3 Claims, 22 Drawing Sheets

(56) References Cited

U.S. PATENT DOCUMENTS

| | | | | | |
|---|---|---|---|---|---|
| 4,974,658 | A * | 12/1990 | Komatsu et al. | 160/310 |
| 5,092,388 | A * | 3/1992 | Evers | 160/269 |
| 5,555,684 | A * | 9/1996 | Galowitz et al. | 52/204.5 |
| 6,073,412 | A * | 6/2000 | Verch | 52/656.5 |
| 6,123,135 | A * | 9/2000 | Mathews | 160/26 |
| 6,223,803 | B1 * | 5/2001 | Nielsen | 160/98 |
| 6,427,397 | B1 * | 8/2002 | Kolaschnik | 52/204.5 |
| 6,470,638 | B1 * | 10/2002 | Larson | 52/302.1 |
| 6,470,947 | B1 * | 10/2002 | Holevas | 160/28 |
| 2003/0226321 | A1 * | 12/2003 | Engebretson | 52/204.54 |
| 2005/0022943 | A1 * | 2/2005 | Thomas et al. | 160/27 |
| 2008/0072506 | A1 * | 3/2008 | LeGoff | 52/204.1 |

* cited by examiner

WINDOW REVEAL SYSTEMS AND METHODS

CROSS-REFERENCE TO RELATED APPLICATIONS

This application claims the benefit of priority under 35 U.S.C. §120 as a continuation of U.S. application Ser. No. 12/793,536, filed Jun. 3, 2010.

BACKGROUND

1. Field of the Invention

The present invention is in the field of construction and remodeling, and more particularly relates to windows and window reveals.

2. Description of the Related Art

Once a window has been initially installed in a structure substantial finishing work remains before construction is complete. The portion of the structure immediately adjacent the window, known as the window reveal, typically is finished by hand. Such finishing work typically involves applying furring strips and then drywall around the window, installing corner bead, taping (which typically includes mudding, or applying joint compound), sanding, texturizing, painting, and then cleaning leftover mud and paint from the window frame and glass. Each of these tasks is usually performed by a different worker having the respective specialty. This process is time-consuming and fraught with inconsistencies and imperfections, leading to uneven dimensions and a high incidence of construction defects.

SUMMARY

Thus, there is a need in the art for improved devices and methods that provide a more consistent, simpler, and higher finish quality window reveal, as well as a faster process for constructing the window reveal.

In one embodiment, a window has a slot formed in its frame. The slot opens toward the interior of the associated structure. An elongate reveal trim has two faces arranged in a generally L-shaped cross-section and has a length matching the length of one side of the window. An elongate edge of one of the reveal trim faces fits into the slot along its length so as to extend from the slot. The other face of the L-shaped reveal trim attaches to the wall structure adjacent the window.

Preferably four reveal trims are provided, one for each side of a typical, rectangular window, and preferably the reveal trims are sized to fit precisely within the pre-manufactured window slot and to abut one another. Most preferably, each reveal trim end is formed at a 45° angle so that, when installed, ends of adjacent reveal trims engage one another.

In practice, once the window is mounted in the structure, a single worker can install the window reveal by fitting each reveal trim in its corresponding slot and attaching each reveal trim to the wall structure. As such, a single worker can install and finish a window reveal quickly and easily and with little need for extensive training and experience in the building trades. Also, with this system and method the window is spaced from building materials such as joint compound and paint, so likely there is little or no window cleanup necessary. Additionally, prefabricated reveal trims that closely match window sizes enable construction of a window reveal that is dimensionally correct and square.

In one embodiment, a window reveal kit can include a window, a first connector, and at least one reveal trim. The window has a first side, a second side, and a frame portion about a perimeter of the window. The first connector is formed on the frame portion, on the second side of the window. The at least one reveal trim has a second connector that is configured to engage the first connector so that the reveal trim extends from the first connector.

In another embodiment, a method of forming a window reveal is provided. A window can be mounted to a building frame structure. The window can have a frame about its perimeter and the frame can have a first connector formed thereon. A wall member can then be applied near a perimeter of the window. Further, a reveal trim can be connected to the window via a second connector interacting with the first connector. The reveal trim include the second connector, a body portion, and a mount portion. The mount portion of the reveal trim can be attached to the structure.

In another embodiment, a window frame is provided. The window frame can include a substantially flat and clear glass pane. A frame can be mounted around the glass plane to secure the glass pane and provide structural support to the glass pane. Finally, the frame can have a slot oriented generally perpendicular to a plane of the glass pane. The slot can extend about the entire perimeter of the glass pane.

BRIEF DESCRIPTION OF THE DRAWINGS

Further objects, features and advantages of the invention will become apparent from the following detailed description taken in conjunction with the accompanying figures showing illustrative embodiments of the invention, in which:

FIG. 5 A is an enlarged sectional view of an earlier stage of the window system of FIG. 5, indicating the insertion of a reveal trim;

DETAILED DESCRIPTION OF SOME PREFERRED EMBODIMENTS

Described herein are various preferred embodiments of window reveal systems and methods. In an initial simplified embodiment a window reveal system can include a window frame with a prefabricated slot-groove and a plurality of reveal trims (e.g. four reveal trims) that can insert into the slot-groove. The prefabricated slot-groove can extend about the entire perimeter of the window frame, on a portion of the window-frame that faces toward an interior of a structure to which it is applied. When the window frame has been installed within the structure, the reveal trims can insert into the slot-groove to form a reveal trim about the window. Advantageously, the reveal trims can be prefabricated to correspond to the dimensions of the window frame to form a precise window-reveal when inserted. In some embodiments, the reveal trims can also attach to the surrounding structure (e.g. over or under dry wall pieces).

Figure 1:
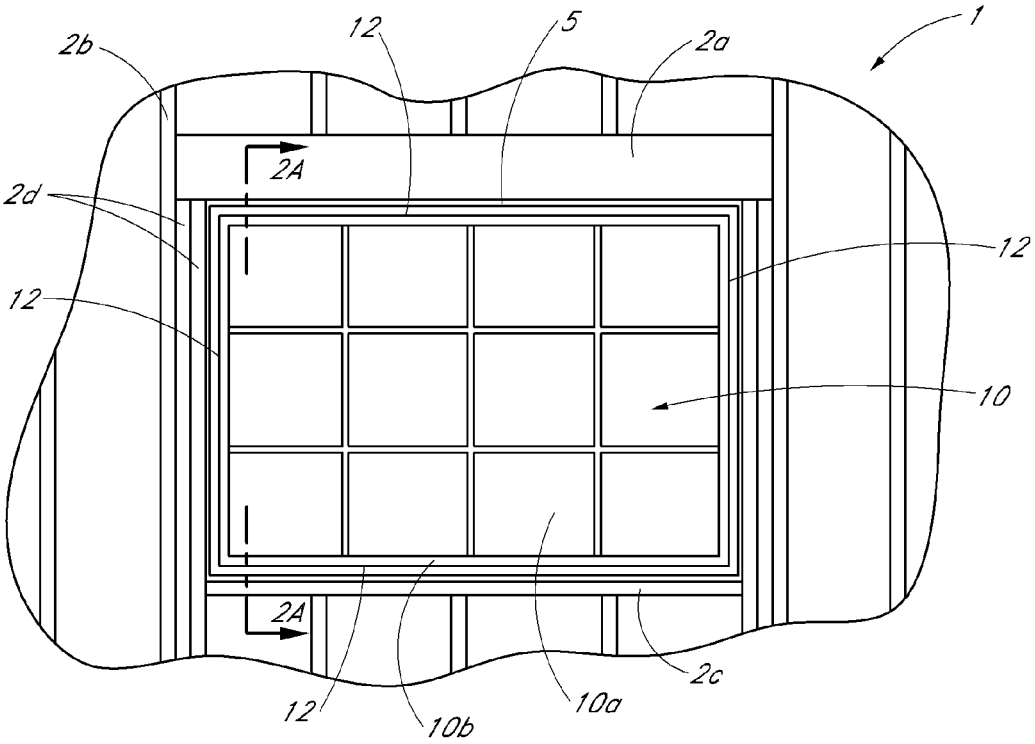
FIG. 1 is an inside view of a portion of a window system mounted within a building frame structure.

A more detailed embodiment of a window reveal system and method is depicted in FIG. 1. A portion of a structure 1 such as a residential building is shown at a stage of construction in which a wooden structural frame 2 of the structure 1 is exposed. The structural frame 2 includes a space for accommodating a separately-manufactured window 10, which window space is defined by opposing king studs 2*b*, a header 2*a*, and a sill 2*c*. As shown, a window 10 is mounted in the window space of the building frame 1. Preferably the window 10 comprises one or more glass panes 10*a* that are enclosed within a window frame 10*b* that can extend about an outer perimeter of the window 10.

Although the systems and methods are described herein in the context of a residence, other structures are contemplated. For example, in other embodiments the systems and methods can be applied to office buildings, free-standing walls, vehicles, and other structures that can include windows or similar elements. Further, the systems and methods can be applied at other stages of construction, such as when a window is replaced during a remodel or other work after initial construction of a building frame structure is completed. Even further, although the embodiments described herein may use specific materials, other materials known in the art can be substituted. For example, although the frame of the building frame structure has been described as using wood, other materials such as steel, concrete, brick, structural foams, etc. are also contemplated.

With reference to FIGS. 1-4, one set of embodiments for systems and methods for installing a window system is depicted. As discussed previously, since the building's structural frame 2 and the window 10 are generally manufactured separately, and especially since the structural frame 2 typically is constructed in the field and may have substantial dimensional variances from design plans and/or inconsistencies, the window 10 may not fit precisely within the window space defined by the frame 2. In such an event, one or more trimmers 2*d* can be added to adjust the size and position of the window space to accommodate the window 10 and its frame 10*b* more precisely.

Figure 2:
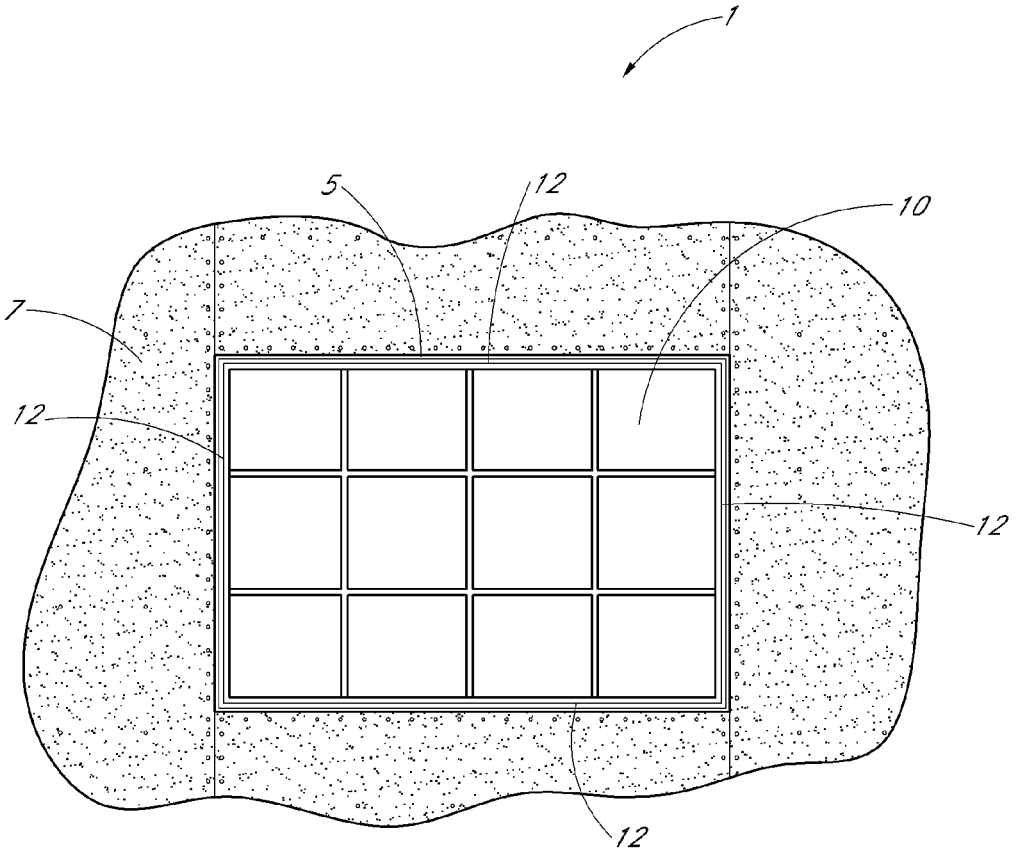
FIG. 2 is an inside view of the window system of FIG. 1 with wall-members mounted to the frame.
Figure 2A:
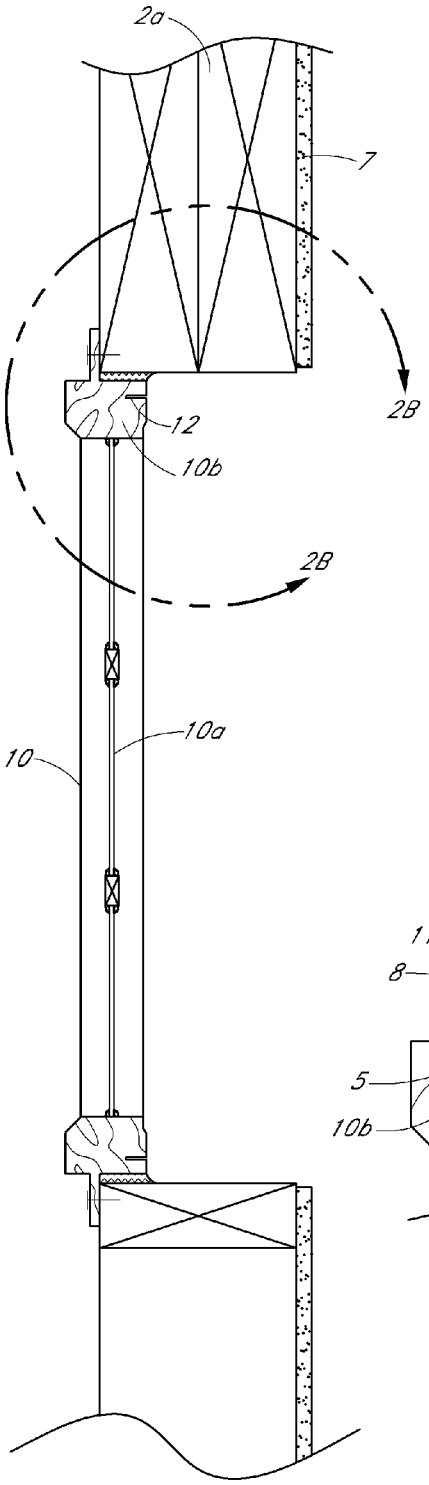
FIG. 2A is a side cross-sectional view of FIG. 2 taken along line 2A-2A.
Figure 2B:
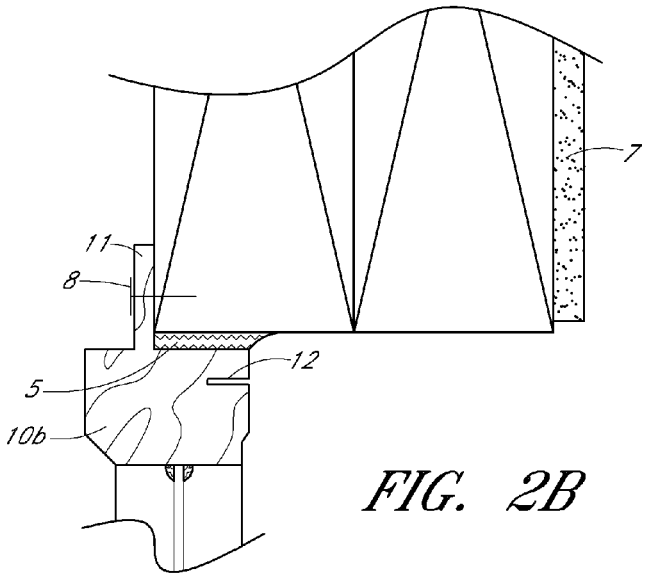
FIG. 2B is an enlarged view of the window system of FIG. 2A at 2B-2B.

FIGS. 2-2B depict the structure 1 during a stage of construction after which the interior walls have been formed. In the depicted embodiment, the interior walls have been formed by wall members 7. The wall members 7 can be attached to the structure 1, or more particularly the structural frame 2 by fasteners such as nails, screws, rivets, or other appropriate materials. The wall members 7 can be gypsum-based wallboard, commonly referred to as drywall, but can also use other materials.

With particular reference to FIGS. 2A and 2B, the window frame 10*b* can include a flange 11 that can mount the window 10 to the building frame structure with the assistance of a fastener 8 so that an exterior side of the window 10 faces generally outwardly (to the left in FIG. 2A) and an interior side of the window 10 faces generally inwardly (to the right in FIG. 2A). It is to be understood that other mounting mechanisms and methods can be employed as desired for mounting a window 10 within a window space. A sealant such as foam 5 can be added to substantially seal any remaining gaps between the window frame 10*b* and the remaining structure of the building such as the header 2*a*, king studs 2*b*, sill 2*c*, or trimmers 2*d*.

As depicted, the window 10 can be a single-layer window with a pane 10*a* supported by an internal grid having a wooden frame. However, a variety of other types of windows 10 are contemplated. For example, in some embodiments the frame can be vinyl, metal, or another material. Further, in some embodiments the window 10 can be a double-pane window or have a different number of layers. In further embodiments, the window 10 can lack a reinforcing internal grid. Further, although the window 10 is depicted as a single pane static window, in some embodiments the window can have multiple sliding panes, at least one of which is able to slide relative to the other. Similarly, in some embodiments the window 10 can be substituted with a door, such as a sliding glass door.

Advantageously, the interior side of the window 10 can also include a prefabricated elongate slot-groove 12 formed in its frame 10*b*, extending around its entire periphery, as depicted in FIG. 1. The slot-groove 12 can be configured to receive one or more reveal trims 20.

Figure 3:
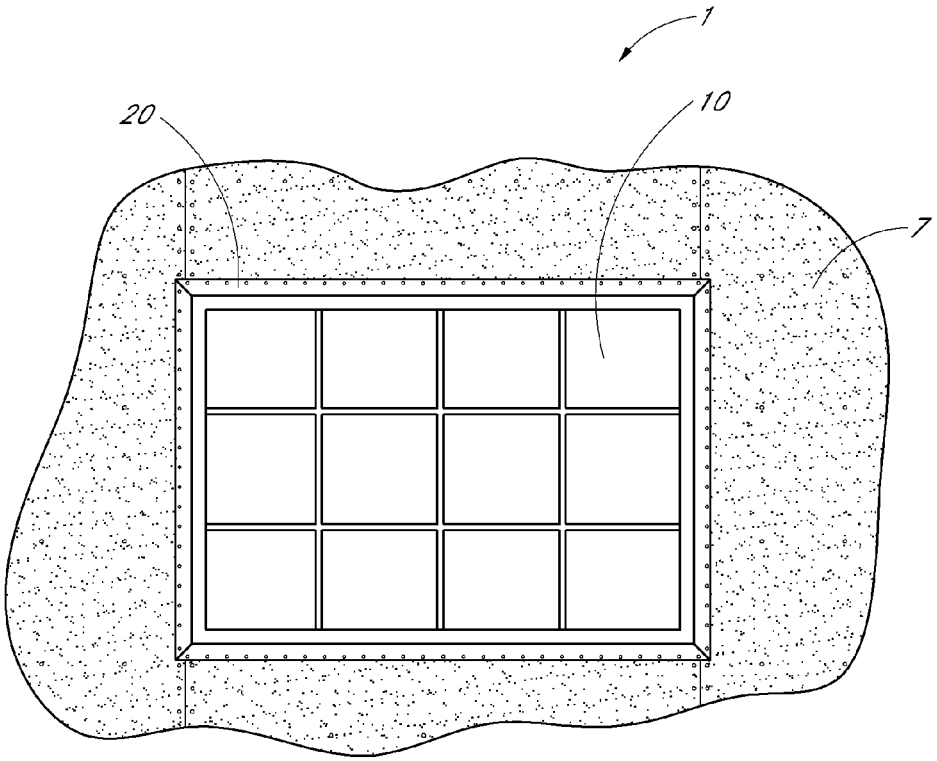
FIG. 3 is an inside view of the window system of FIG. 2 with reveal trims applied thereto.
Figure 3A:
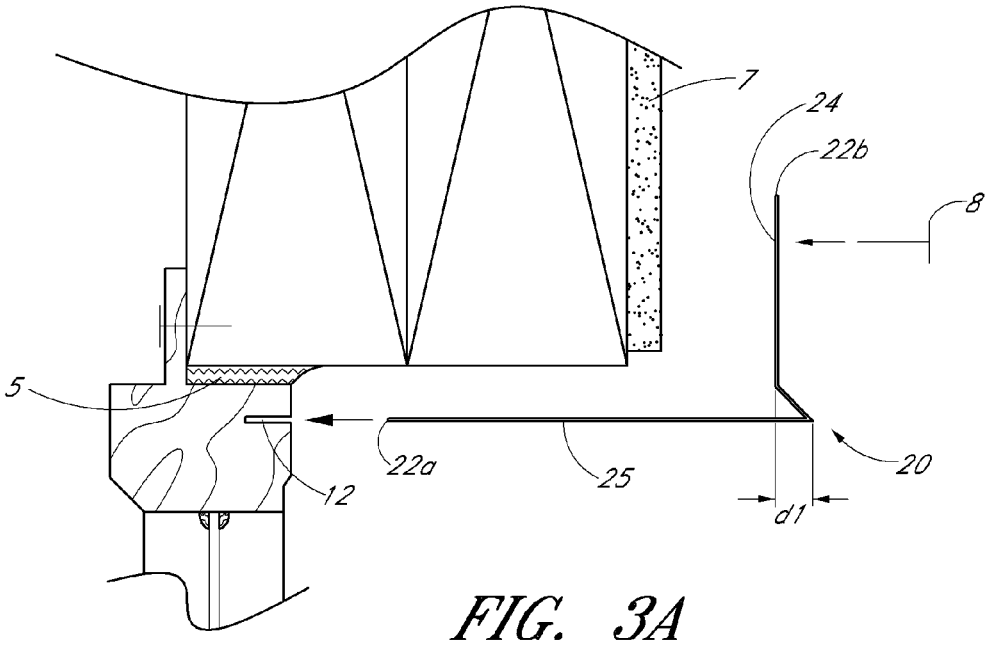
FIG. 3A is a partial-sectional view of the window system of FIG. 3, indicating the insertion of a reveal trim.

As depicted in FIG. 3, the reveal trims 20 extend between the interior side of the window 10 and the adjacent interior wall members 7. With specific reference to FIGS. 3 A and 3B, an illustrated embodiment of a reveal trim 20 is elongate and comprises a first portion depicted as an elongate body 25 extending between a first end 22*a* and a corner section 22*d*. A second portion depicted as a mount flange 27 extends from the body 25 at the corner section 22*d*. In the illustrated embodiment, the corner section 22*d* connecting the mount flange 27 to the body 25 can form a corner bead. As depicted, the corner section 22*d* can form an angle less than 90 degrees between the body 25 and a short transition portion depicted as a recessed portion 23. Preferably the recessed portion 23 transitions to the mount flange 27 which preferably is oriented at about 90 degrees relative to the body 25. As such, a recess space is defined between the corner bead, the recessed portion 23, and the mount flange 27. The recess space can be recessed from the corner section 22*d* by a distance d1. In one preferred embodiment, the distance d1 is expected to be in a range of approximately 1/32 inch to 1/2 inch, and more preferably is about 1/16 inch. Preferably one or more fastener insertion points 24, which in the illustrated embodiments are holes, are included on the mount flange 27. Further, a reveal surface is defined on the side of the body 25 opposite the structural frame 2 (here depicted as the header 2*a*), facing inward toward the window 10.

Figure 3B:
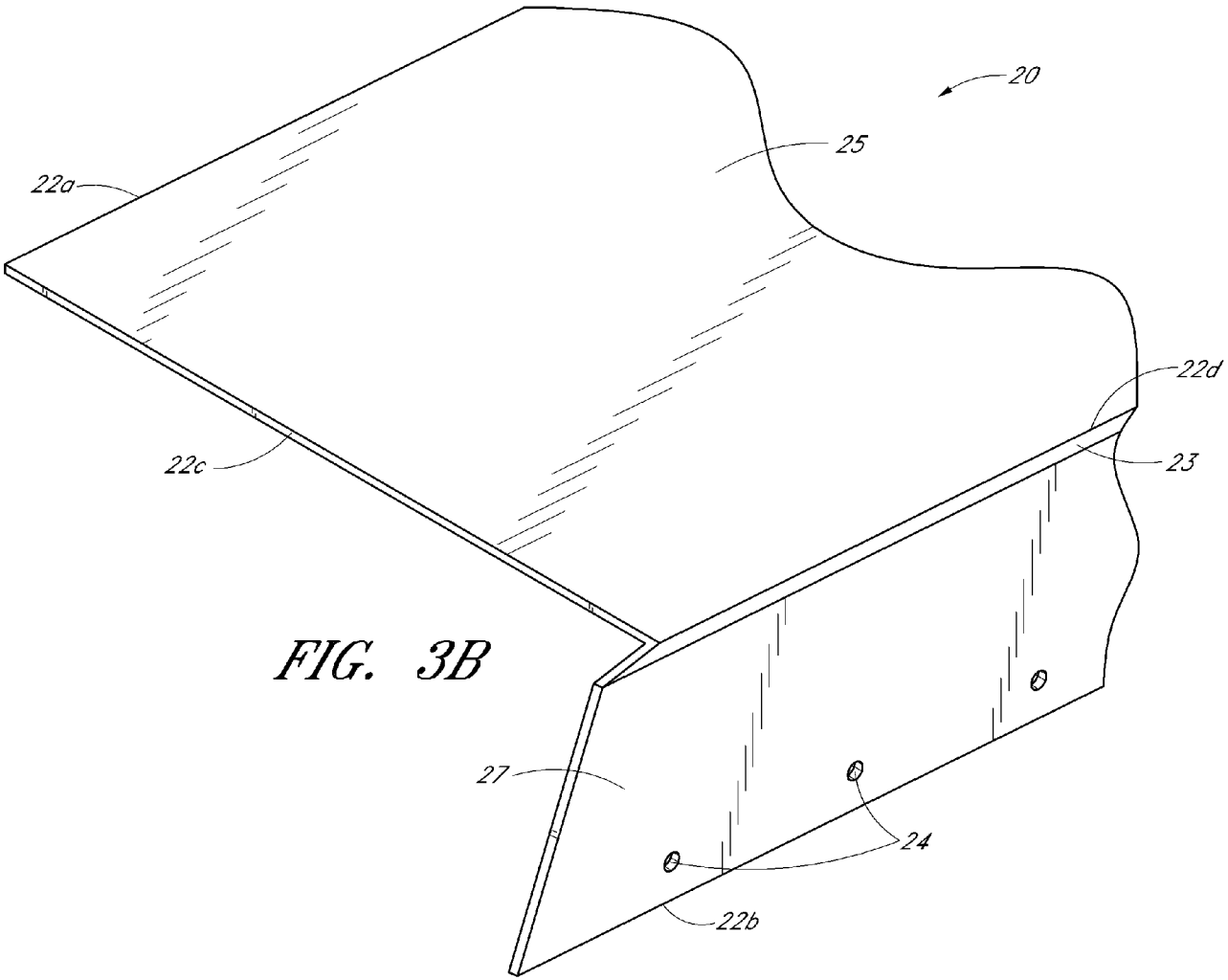
FIG. 3B is a perspective view of the reveal trim of FIG. 3A.

As depicted in FIG. 3B, the reveal trim 20 can be of a generally arbitrary length, beginning from a first side end 22*c* and ending at another side end not shown. As will be discussed further below, the side end 22*c* can be substantially straight along the elongated body 25. However, as depicted in FIG. 3, at the corner section 22*d* the side end 22*c* can form a 45 degree angle extending outwardly along the flange 27 and the recessed portion 23, such that it can fit with another angled trim oriented perpendicularly thereto. However, in other embodiments other angles and shapes of the side end 22*c* can be formed, as will be further discussed below.

The trims 20 can be produced in a variety of ways. For example, the embodiment depicted in FIG. 3B can be composed of a sheet of material that is folded into shape. In other embodiments, the trims 20 can be extruded or molded. In even further embodiments, the trims 20 can be cut to a desired shape. Additionally, in some embodiments the trims 20 can be formed from multiple pieces attached together. Combinations of these production methods can also be combined to form appropriate trims 20.

Referring again to FIG. 3 A, the trim 20 can be installed by aligning the first end 22*a* with the slot-groove 12 and inserting therein until the mount flange 27 engages the wall member 7. Preferably the trims 20 are secured to the building frame structure (directly or indirectly) by fasteners 8 such as nails, screws, adhesive, etc. These can be provided, for example, through the mount flange 27, or through its fastener insertion points 24.

To accommodate variations in window mounting, in some embodiments the slot-groove 12 can have a depth sufficient so that the mount flange engages with the wall member 7 (or other structures) before the first end 22*a* encounters the bottom of the slot-groove. Further, in some embodiments the slot-grooves 12 can extend along other portions of the window 10, such as along only a portion of the internal frame (e.g. only the sides, top, or bottom). In general, the slot-grooves 12 can be formed to stably receive a variety of trims 20, described below.

To facilitate entry of the trim's first end 22*a* into the slot-groove 12, the first end 22*a* and the slot-grooves 12 are depicted to be substantially planar and perpendicular to the primary plane of the window frame 10. However, in other embodiments the first end 22*a* and slot-groove 12 can have different shapes and orientations, such as an arc, bend, or an angle non-perpendicular to the primary plane of the window frame 10. In additional embodiments, the elongate body 25 can bend external of the slot-grooves 12, such that the elongate body can extend at an angle from or offset from the grooves. Generally, the slot-groove 12 can define a specific position for the reveal trim 20, such that the position of the trim can be predefined during the fabrication of the window 10. In other embodiments, the trim 20 can attach in a predefined position by other means, such as a pre-tapped screw hole, hook-hole combination, a dove-tail joint, or some other form of key-slot combination. Further, in some embodiments multiple means can be used, potentially at different positions, thus further securing the reveal trims 20.

Once the trim 20 is mounted in the slot-groove 12, as best depicted in FIG. 3 A, a fastener 8 can pass through the fastener insertion point 24 as well as the dry wall 7, mounting both the reveal trim 20 and the dry wall to the building frame structure, such as the header 2*a*, king stud 2*b*, or sill 2*c*. The fastener can be a screw, nail, rivet, or any other type of fastener generally known in the art. Further, in some embodiments the reveal trim 20 can attach to the building frame structure by other types of fasteners such as caulking, welds, adhesive, Velcro™, or the like. Prior to fastening, the trims 20 can be inspected for appropriate alignment and fit, such that they can then be fastened in appropriate position.

Once the reveal trim 20 has been inserted into the slot-groove 12 and secured, its reveal surface on the elongated body 25 can be visible. The reveal surface on the body 25 can have different aesthetic qualities from the remainder of the reveal trim 20. For example, in some embodiments the reveal surface can have a particular color, design, texture, or structures for attachment of another piece having such aesthetic qualities.

As depicted in FIG. 3, four reveal trims 20 can span the entire perimeter of the window 10. Thus, the ends of the reveal trims 20 can have matching or interengaging shapes to create a tight fit at their edges. As depicted in FIG. 3B and discussed above, the trim 20 can have a side end 22*c* oriented at a 45 degree angle at the corner section 22*d*. Thus, an adjacent and perpendicular trim 20 also having a 45 degree angled side end 22*c* can abut along its entire side end. However, other embodiments may vary. For example, in some embodiments, side ends 22*c* may be angled at 90 degrees, with alternating trims having extended portions at their side ends to abut neighboring 90 degree ends and thus form, e.g., a complete rectangular trim. In other embodiments, the trims 20 may abut along only a portion of their side ends 22*c*. Further, in some embodiments the trims 20 can abut using different angles, such as the combination of a 30 degree angled trim abutting a 60 degree angled trim. In some embodiments, the abutment between trims 20 can be finalized and/or sealed with caulking, foam, fasteners, or the like. Even further, in some embodiments it may be desirable to only provide a reveal trim 20 on the sides or only on the top and/or bottom of the window 10. In other embodiments, it may be desirable for the reveal trims 20 to only span a portion of any given side. Selective placement of the trims 20 can be made as long as slot-grooves 12, or other attachment structures such as those described herein, are available in the relevant positions.

Figure 4:
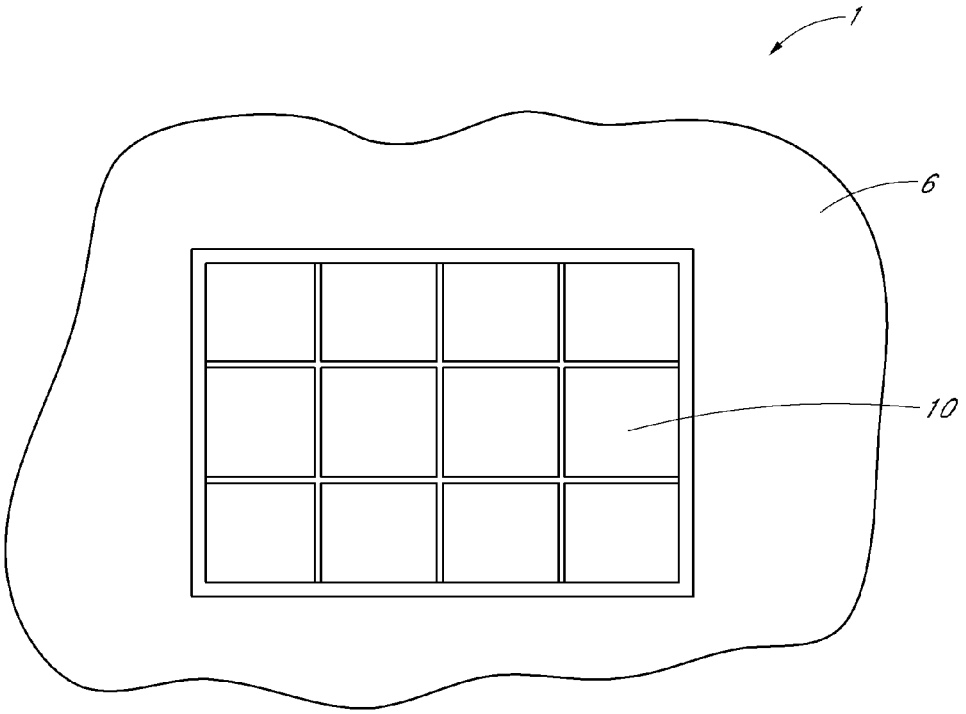
FIG. 4 is an inside view of the window system of FIG. 3 with at least some finishing work completed.
Figure 4A:
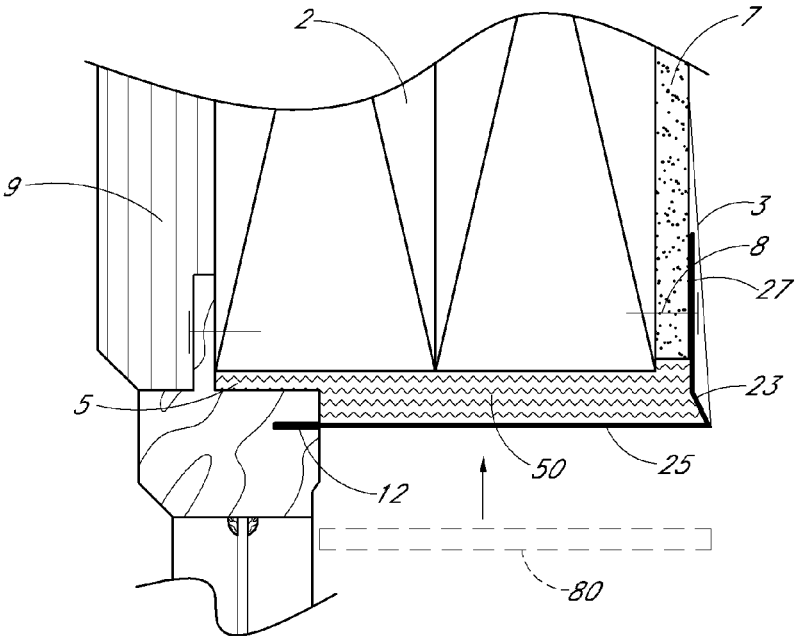
FIG. 4A is a partial-sectional view of the window system of FIG. 4.

As depicted in FIGS. 4, 4A, once the trims 20 and the dry wall 7 have been positioned and fastened, tape 6 and other finishing can be applied over the dry wall 7 and trims 20, and stucco 9 can be applied to the exterior portion of the window frame 10, to finalize the wall and window system 1. If necessary, joint compound, commonly referred to as mud 3, can be applied at the border between the reveal trim 20 and the dry wall 7 to provide a smoothed surface, as best depicted in FIG. 4A. The mud 3 can be applied to the recessed space generally near the recessed portion 23 and along the flange 27. The mud can thus smooth rough portions related to fasteners 8, creases between the trim 20 and wall 7, or the like. A preferred embodiment contemplates using a joint compound as the mud. However, in other embodiments other materials can be used such as tape, plaster, or the like.

In some embodiments, the reveal surface on the elongate body 25 can be pre-covered with a protective tape such that the mud 3 or other finishing materials can be applied quickly and easily without contaminating the reveal surface. In such embodiments, the protective tape is removed once the interior wall finishing work is complete. Further, additional foam 5 can be inserted into any gaps between the trim 20 and the remaining structure, such as the space 50 between a reveal surface of the trim and the building frame structure. In some embodiments, the trim 20 can include an additional hole for insertion of the foam 5. The hole for insertion of foam can be positioned at a variety of places along the trim 20. In some embodiments, the hole for foam insertion can be along the recessed portion 23 or the flange 27 of the trim 20, in a region that will be mudded over before finalizing the window system 1. In other embodiments, the foam insertion holes can be along the elongated body 25, and the hole can then be covered by an insert, caulking or the like.

In another embodiment, and as shown in phantom in FIG. 4A, a decorative piece 80 can be attached to the reveal surface of the elongated body 25 of the reveal trim 20. The reveal trim can be configured to receive the insert 80, which can then generally form a new reveal surface over the integral reveal surface of the elongated body 25. Such inserts 80 can be irreversibly attached (e.g. by adhesive, spray, weld, interlocking structure, etc.), or reversibly attached (e.g. by Velcro™, weakened adhesive, magnet, hooks, etc.). Advantageously, the inserts 80 can have a variety of textures, colors, designs, etc., that can be easily substituted. Further, the inserts can obscure other features such as holes for insertion of foam into the space 50. In further embodiments, the inserts 80 can be provided as a kit with a plurality of colors, designs, and/or patterns, such as to match seasons, which can be changed periodically to change the look of the window reveal without reconstruction. Further examples of reversibly attached inserts 330 are described below in relation to the embodiments of FIGS. 6A-6C.

Advantageously, the trims 20 can be relatively easily removed and replaced from the slot-grooves 12 and the building frame structure 2, such as the components 2*a*, 2*b*, 2*c*. Thus, for example, if a new reveal trim 20 should be installed (for example to provide a reveal surface with a different aesthetic quality), it can be relatively easily done. In the embodiment of FIGS. 1-4, the mud 3 and tape 6 can be removed to expose the reveal trim 20 and its associated attachments to the remainder of the window system 1. Where the reveal trim 20 is reversibly attached (e.g. by screws) it can be removed and replaced. Advantageously, the reveal trims 20, window frames 10, and the slot-grooves 12 can have standard sizes that provide substantial interchangeability.

Figure 5:
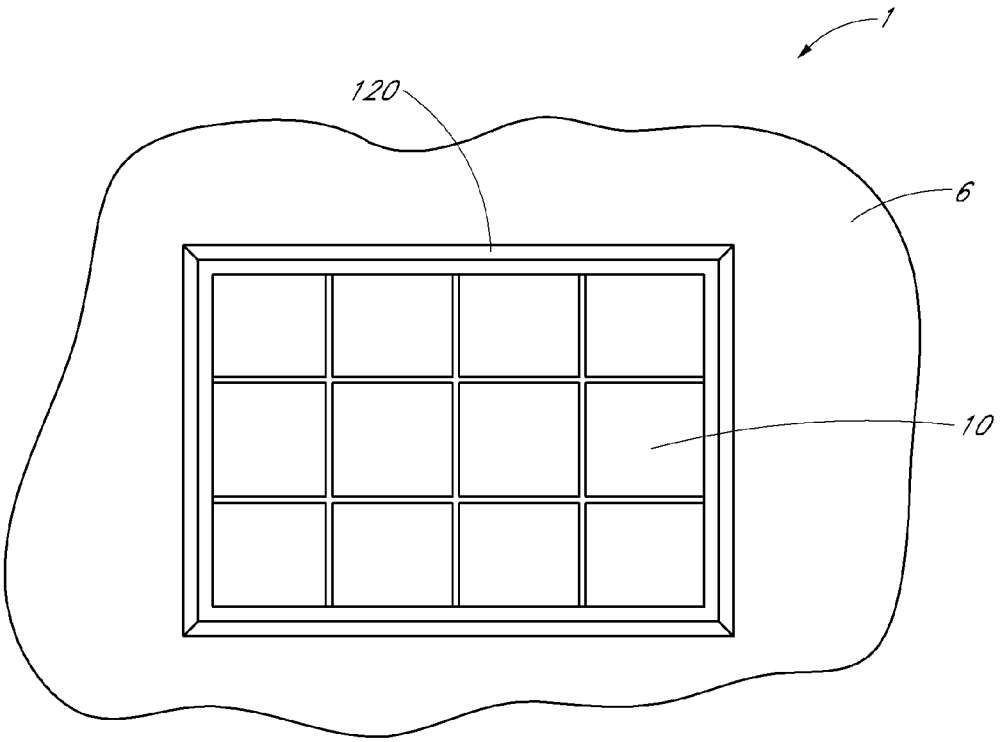
FIG. 5 is an inside view of another embodiment of a window system with at least some finishing work completed.
Figure 5A:
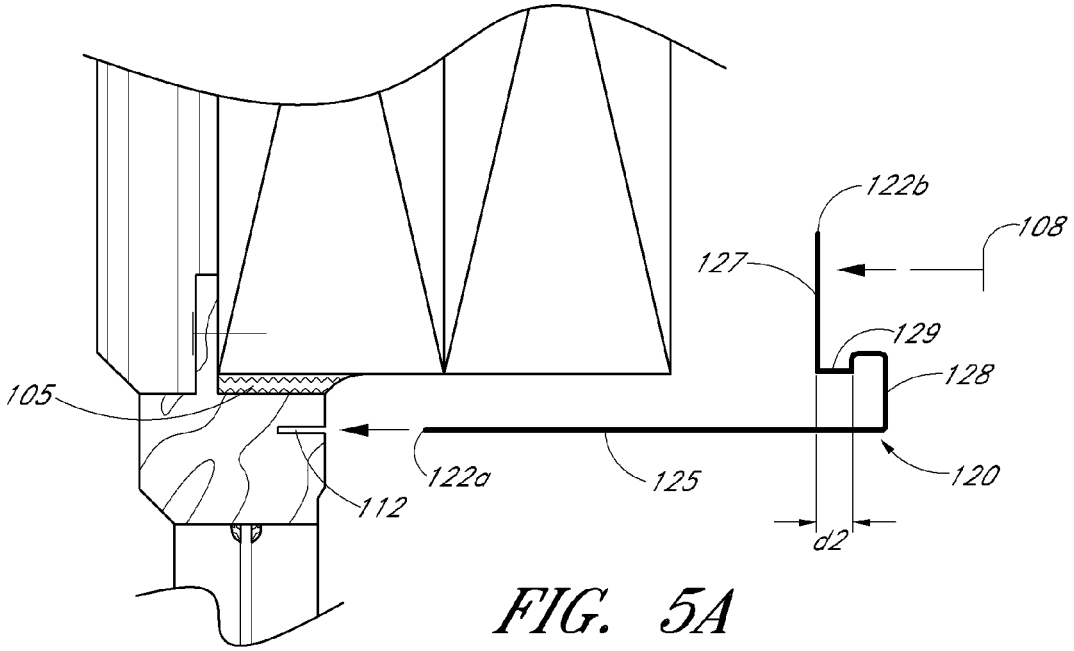
FIG. 5B shows the window system of FIG. 5 A indicating the insertion of a wall member.
FIG. 5C shows the window system of FIG. 5B indicating the securement of the wall member.
Figure 5B:
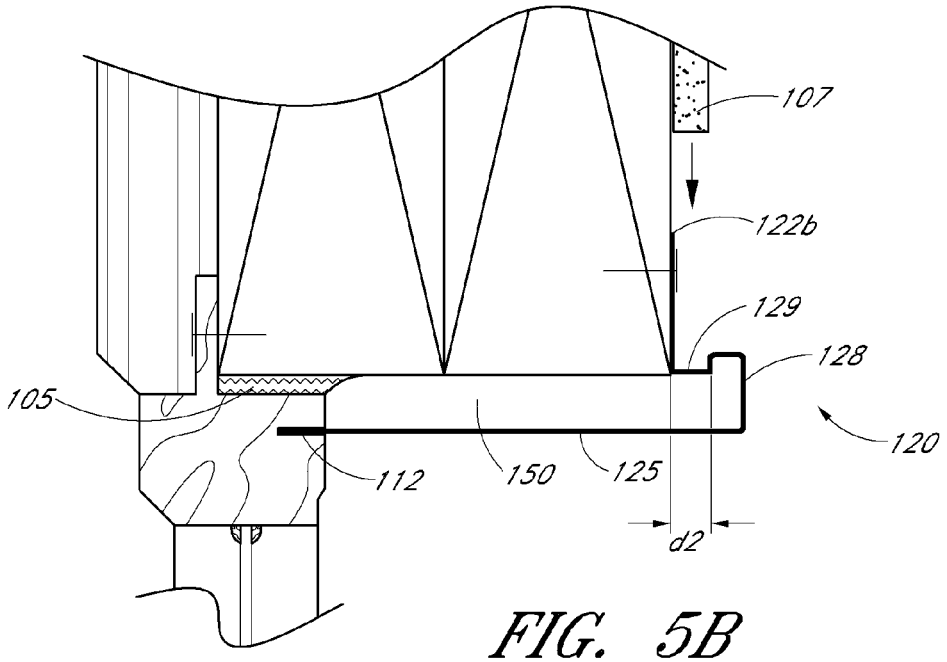
Figure 5C:
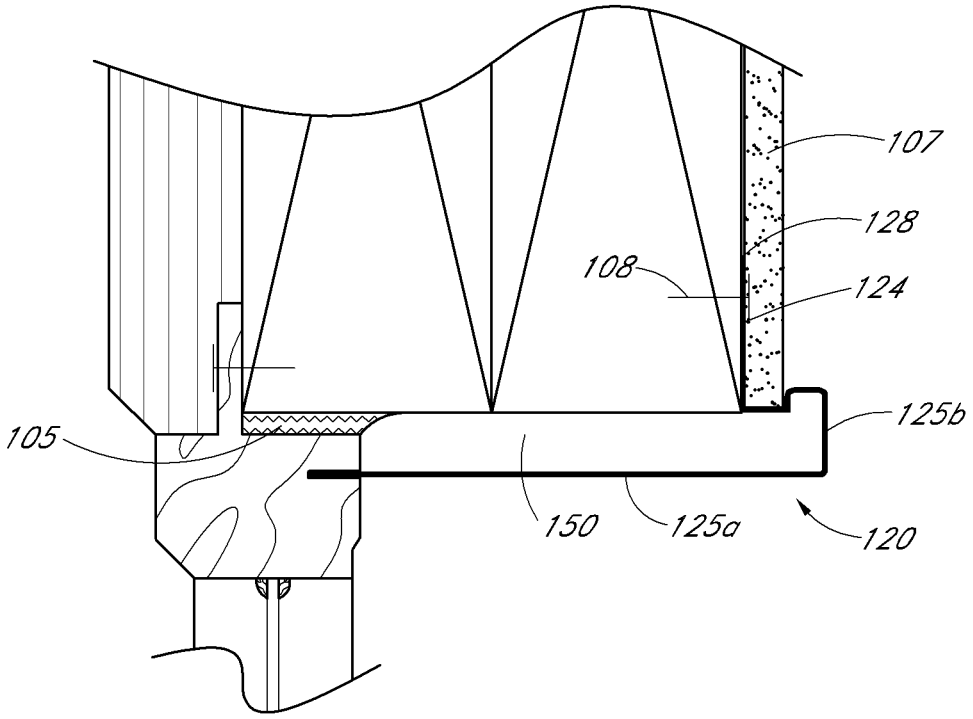

FIGS. 5-5C depict another embodiment window system sharing some similarities with the window system of FIGS. 1-4, but also having additional inventive features. Unless otherwise noted, the elements depicted in FIGS. 5-5C share some similarities with similarly numbered elements of FIGS. 1-4, such as reveal trims 20 of FIGS. 1-4 and reveal trims 120 of FIGS. 5-5C. As depicted in FIG. 5, the finished window system can include a portion of the reveal trim 120 showing a face non-perpendicular to the window 10. Thus, the embodiment of FIGS. 5-5C can provide a different aesthetic quality, in addition to other differences.

As best depicted in FIG. 5A, the reveal trim 120 can be substantially similar to that described in the embodiments above, but can differ generally at the transition between an elongated body 125 and a flange 127. More particularly, whereas the embodiment of FIG. 3B has a straight recessed portion 23, the embodiment of FIG. 5 A can have a more complex geometry. As shown, a third portion 128, depicted as a lip, can extend at a generally 90 degree angle from the body 125. It can then form an additional 90 degree angle to form a general U-shape, and then turn again to form a receiving portion 129. The receiving portion 129 can thus be defined by a rear, non-viewing portion of the lip 128, the flange 127, and a connecting portion extending between the lip to the flange 127 generally parallel to the elongate body 125. In the illustrated embodiment the rear portion is transverse to, and more particularly generally perpendicular to, the elongate body 125 and the connecting portion. As depicted, the receiving portion 129 can have a cross-sectional width d2 between the flange and the rear portion. In a preferred embodiment, the width d2 can be expected to be in a range of approximately ⅝ inch to ½ inch, although embodiments having still different widths can be expected depending upon the thickness of the wall member. In more particular embodiments the width d2 can be slightly greater than the width of a wall member 107.

The reveal trim 120 can insert a manner similar to that of the previous embodiments. However, notably, the reveal trim 120 can be applied prior to the application of the wall member, such as dry wall 107. In this embodiment, the reveal trim 120 is depicted as receiving a fastener 108 before the dry wall 107 has been applied. However, it is also contemplated that similar principles can be applied to trims receiving a fastener 108 after the dry wall has been applied.

The reveal trim 120 can include a reveal surface on the elongated body 125, similar to that of the previous embodiments. However, the reveal trim 120 can also include a second reveal surface on the third portion 128, presented as being generally perpendicular to the first reveal surface on the body 125. The second reveal surface can abut adjacent reveal trims 120 on side ends in a manner similar to that described above regarding other embodiments. Further, the second reveal surface can have a similar variety of aesthetic properties.

The dry wall receiving portion 129 can create a space occluded by the lip 128 and more particularly by its second reveal surface. The dry wall receiving portion 129 can thus receive the dry wall 107 and occlude its edge. Thus, a relatively unfinished and jagged dry wall 107 can be installed without leaving any visible indication that the dry wall's edge may be imperfect. In a preferred embodiment, the receiving portion 129 can have a depth sufficient to hide such imperfections. Further, in some embodiments the width d2 of the receiving portion 129 can be slightly larger than the width of the dry wall 107, such that a small gap is left to allow access for finishing work on the dry wall 107 within the receiving portion 129. However, in other embodiments the dry wall 107 can have a width approximately equal to the width d2 of the receiving portion 129 so as to create a tight fit.

Figure 6A:
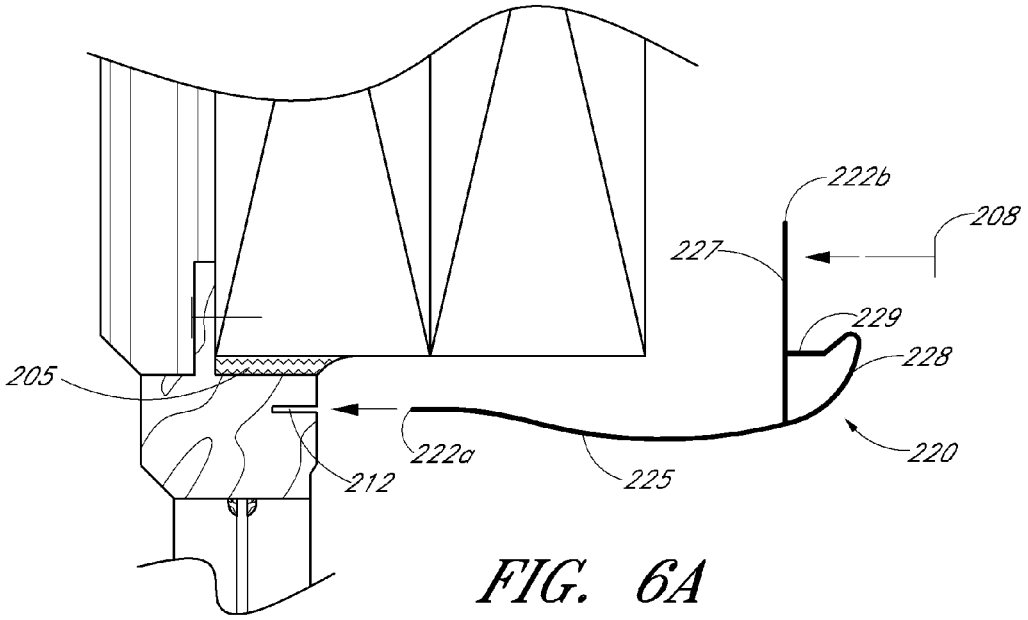
FIG. 6A is a partial-sectional view of another embodiment of a window system, indicating the securement of a wall member.
Figure 6B:
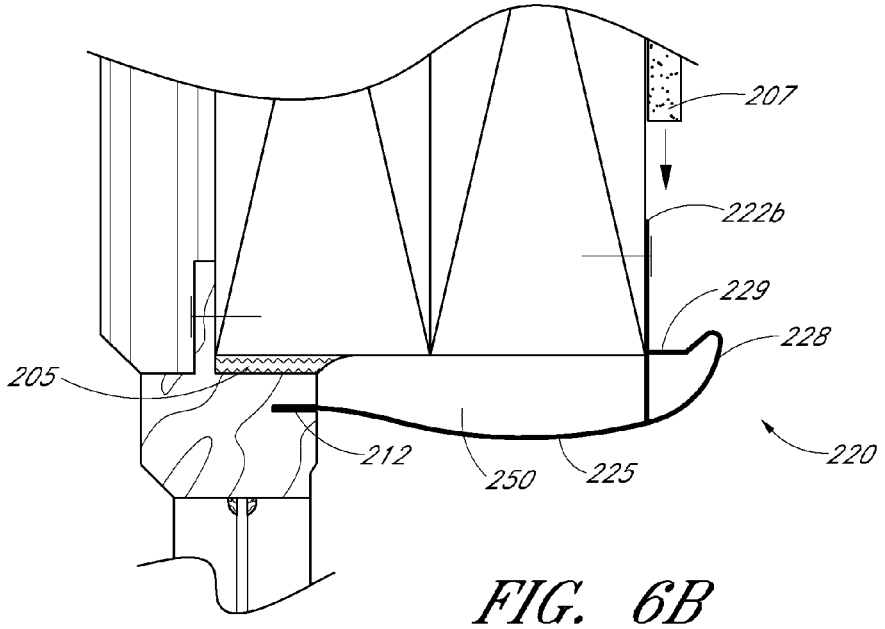
FIG. 6B shows the window system of FIG. 6A indicating the application of an insert.
Figure 6C:
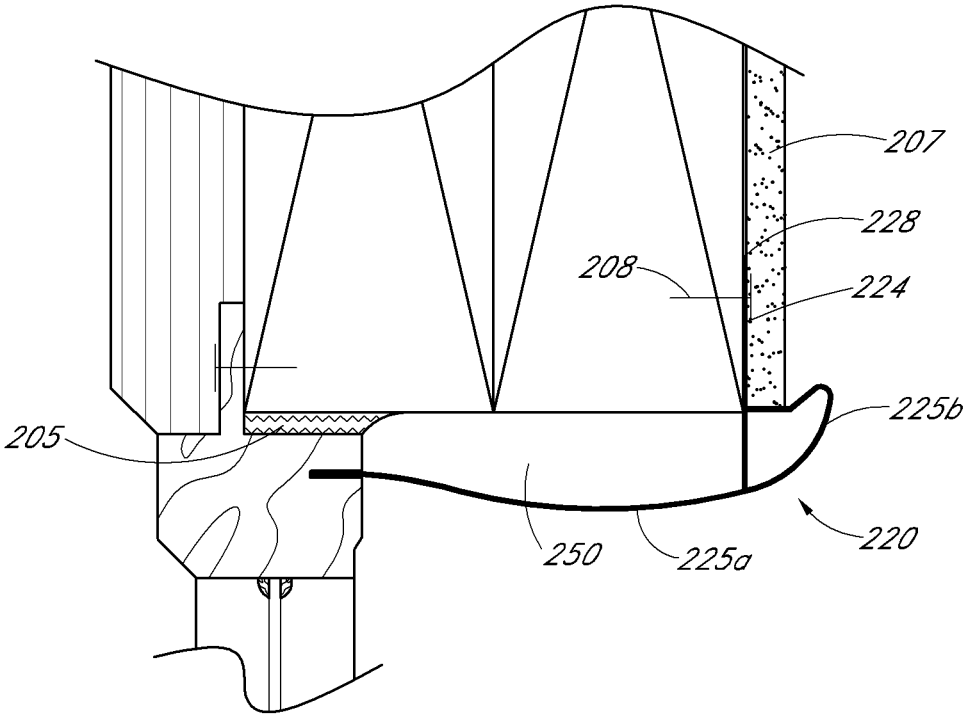
FIG. 6C shows the window system of FIG. 6B after the application of the insert.

FIGS. 6A-6C depict a further embodiment of a window system. As depicted, the window system of FIGS. 6A-6C can be somewhat similar to the embodiments of FIGS. 5-5C (also with similar numbering of elements), but with some additional inventive features. As depicted in FIGS. 6A-6C, the elongated body 225 can be curved over a substantial portion of its length. However, as depicted, the first end 222*a* can remain straight for entry into a straight slot-groove 212. The curve can continue to the dry wall receiving portion 229, smoothing the third portion 228 with the elongate body 225. Further, the dry wall receiving portion 229 can be formed from a smooth and curved lip 228, as opposed to the box-like lip of FIGS. 5A-5C. The smoothed lip 228 can advantageously allow some access to the end of the wall 207 abutting the dry wall receiving portion 229, such that finishing work can be performed inside this recess. However, the lip 229 can also occlude this end of the wall 207 from view, reducing the visibility of any imperfections in the finishing work.

Figure 7A:
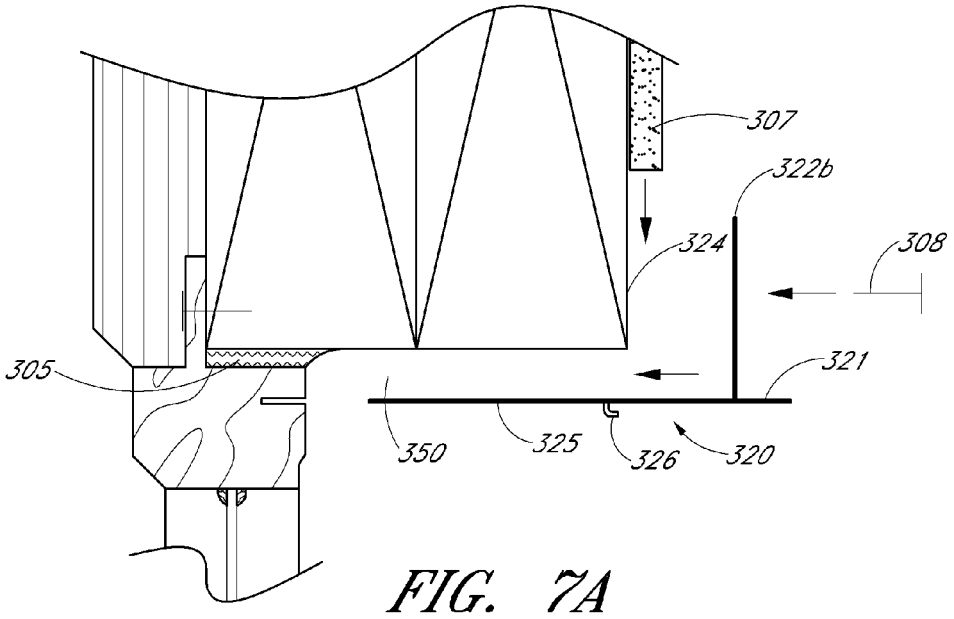
FIG. 7A is a partial-sectional view of another embodiment of a window system, indicating the insertion of a reveal trim.
Figure 7B:
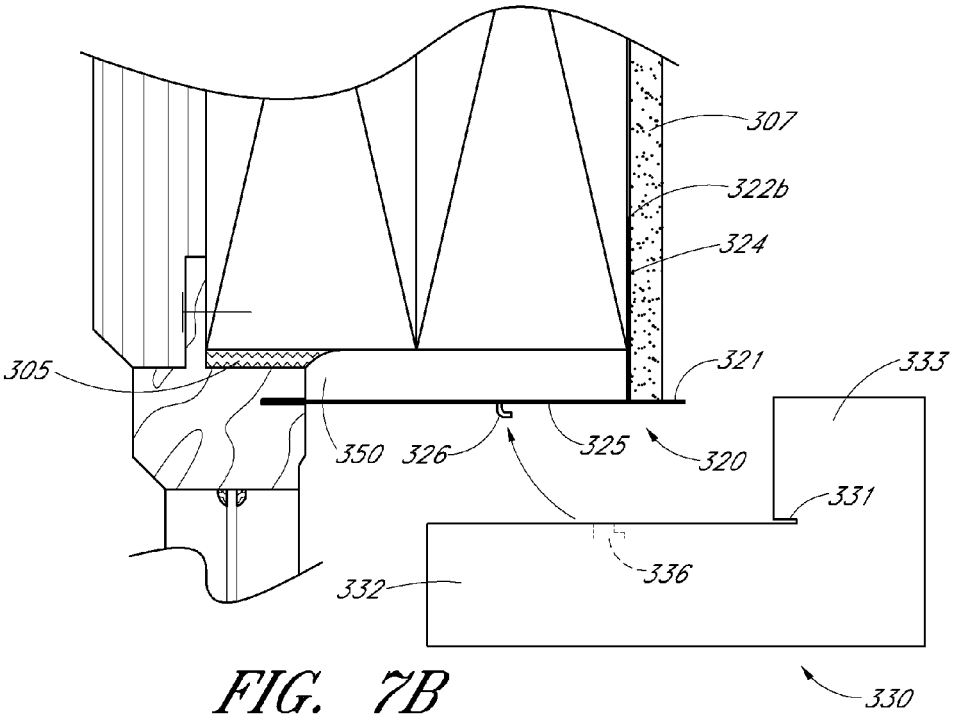
FIG. 7B shows the window system of FIG. 7A indicating the insertion of a wall member.
Figure 7C:
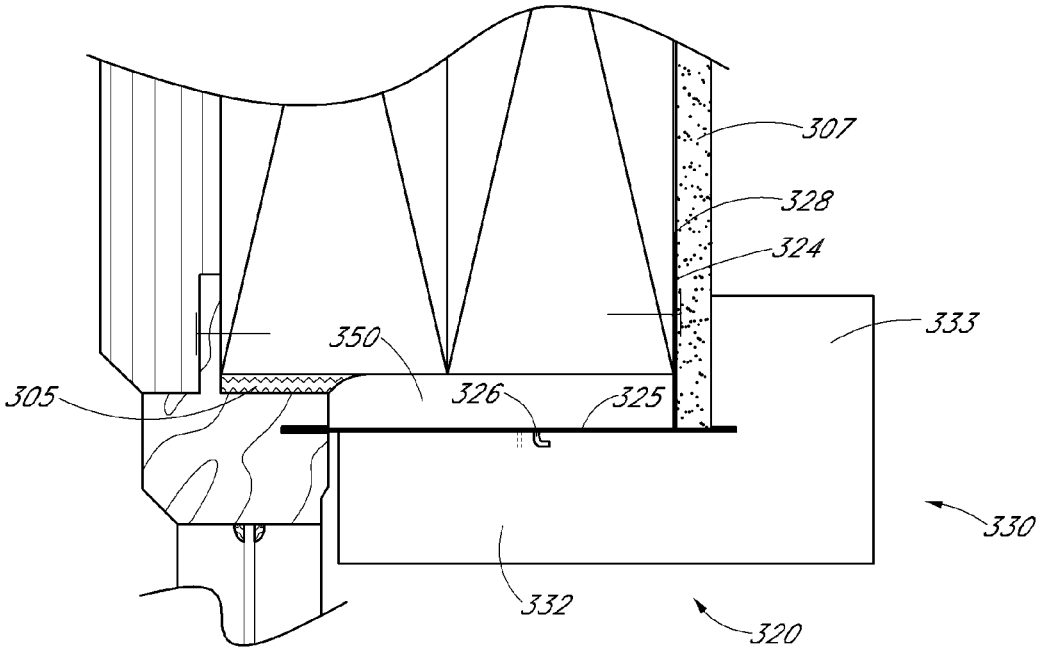
FIG. 7C shows the window system of FIG. 7B after the application of the wall member.

FIGS. 7A-7C depict yet another embodiment of a window system. Generally, the embodiment of FIGS. 7A-7C can create a decorative look similar to that depicted in FIG. 5. However, in this embodiment the design can be more modular and interchangeable. Further, as depicted the embodiments of FIGS. 7A-7C can include inserts 330 that produce a much larger reveal than that depicted in FIG. 5, although different sizes are also contemplated.

As best depicted in FIG. 7A, the trim 320 can be generally T-shaped, with a flange 327 attached to an elongate body 325 along the length of the body and extending generally perpendicularly therefrom. The elongate body 325 can extend past the flange 327 and form an extended portion 321 opposite a first end 322*a*. Further, along the elongate body 325 the trim 320 can include one or more connectors 326. The trim 320 can then assemble with the walls 307 and the structural frame 2 in a manner similar to the embodiment depicted in FIGS. 5-5C, with the walls inserting after the trims 320. However, in some embodiments the trims 320 can go over the walls 307, and their application can be reversed.

Once the trims 320 and walls 307 are applied, an insert 330 can be applied. FIG. 7B depicts a demonstrative, simplified insert 330. The insert 330 can have a general L shape with a first leg 332 and a second leg 333. As shown, the insert 330 can include a connector 336 on an inner portion of the first leg 332 and an insert slot 331 generally parallel to the first leg and located at the joint between the first and second legs.

As further depicted in FIG. 7B, the connector 326 and the extended portion 321 of the reveal trim 320 can facilitate attaching an insert 330. For example, the trim's connector 326 can interact with the insert's connector 336 to attach the two together. As depicted, the trim's connector 326 can be a hook and the insert's connector 336 can be a hook receiving hole. Further, the extended portion 321 can enter the slot 331 to enhance the connection. However, other cooperating connectors are contemplated, including reversal of the placement of the hooks/slots and their corresponding structures, as well as other forms of attachment as generally described herein and known in the art. For example, in some embodiments the connectors 326, 336 can be snaps or other connectors including a slide-on track that may or may not include a detent mechanism to hold the insert in place.

The inserts 330 can generally replace the reveal surfaces described in previous embodiments by covering them. Thus, the inserts 330 can provide interchangeable aesthetic features on its viewable surfaces.

Figure 8:
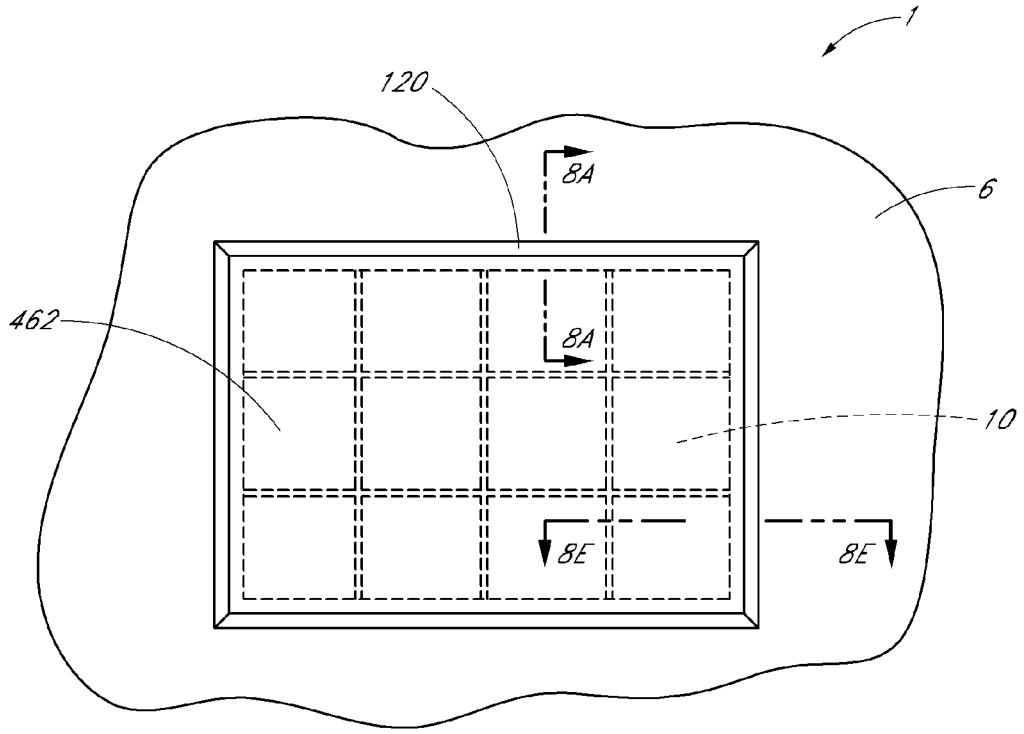
FIG. 8 is an inside view of another window system when with at least some finishing work completed and blinds in a deployed position.
Figure 8A:
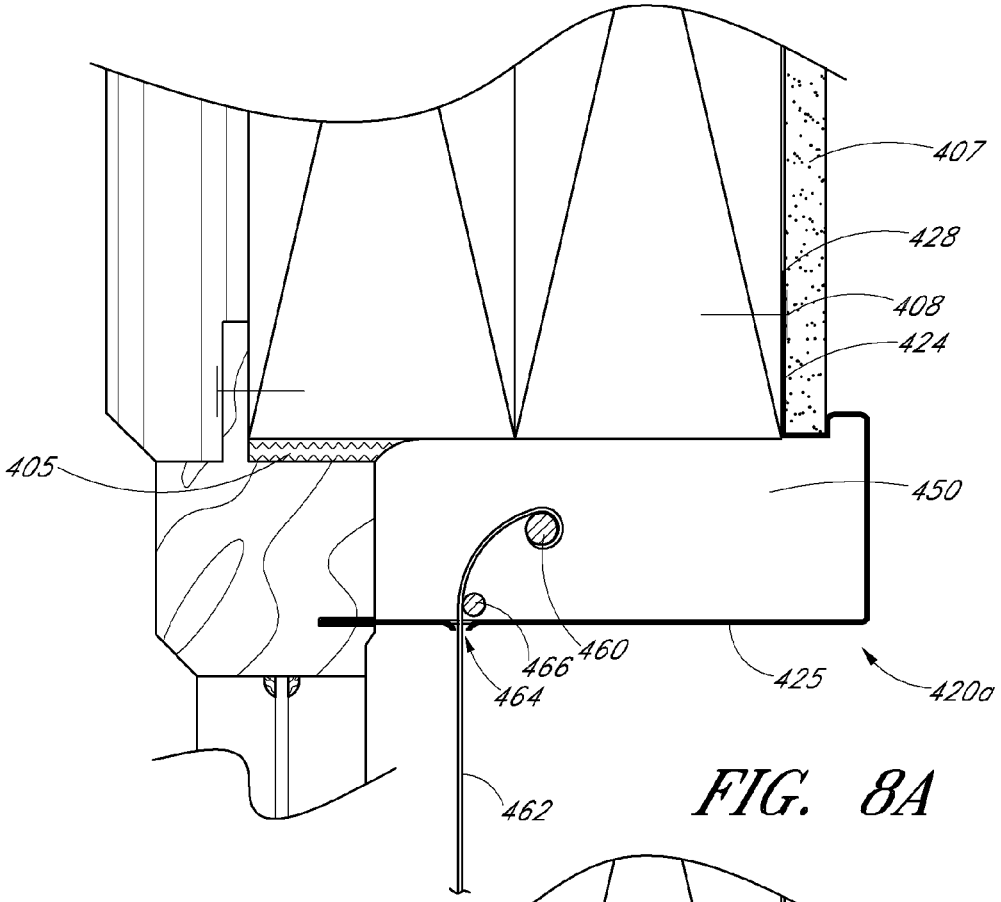
FIG. 8A is an enlarged sectional view of the window system of FIG. 8 along line 8A-8A with blinds in a deployed position.
Figure 8B:
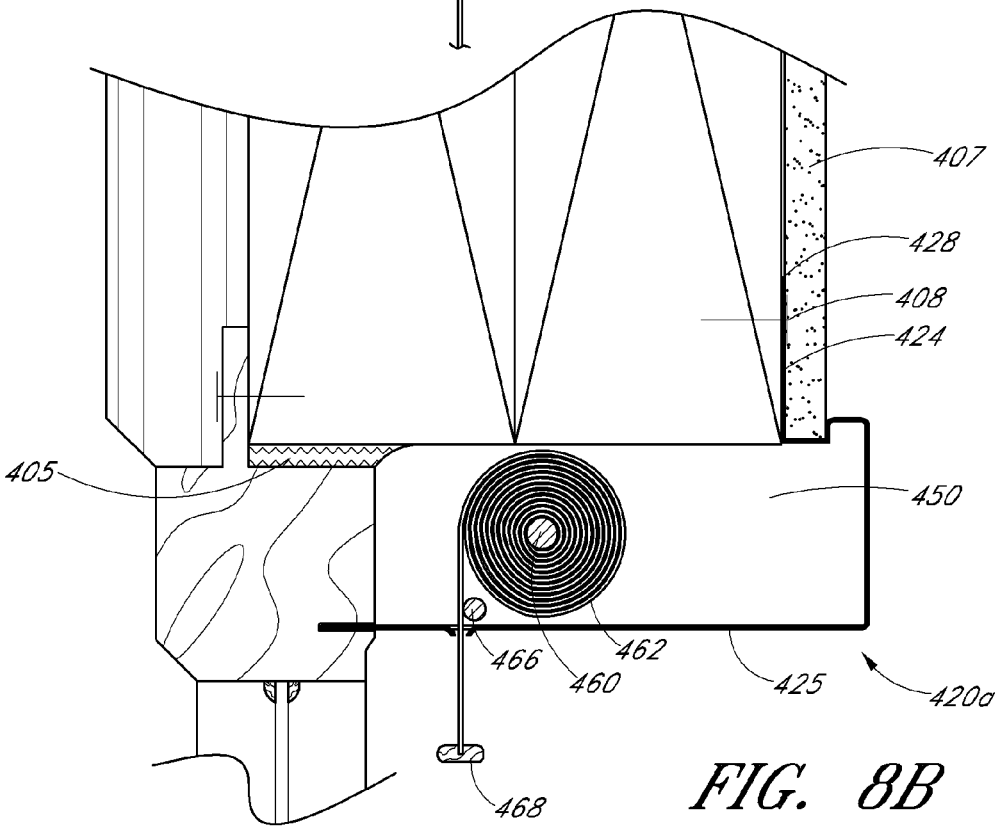
FIG. 8B is an enlarged sectional view of the window system of FIG. 8 A with the blinds in a retracted position.
Figure 8C:
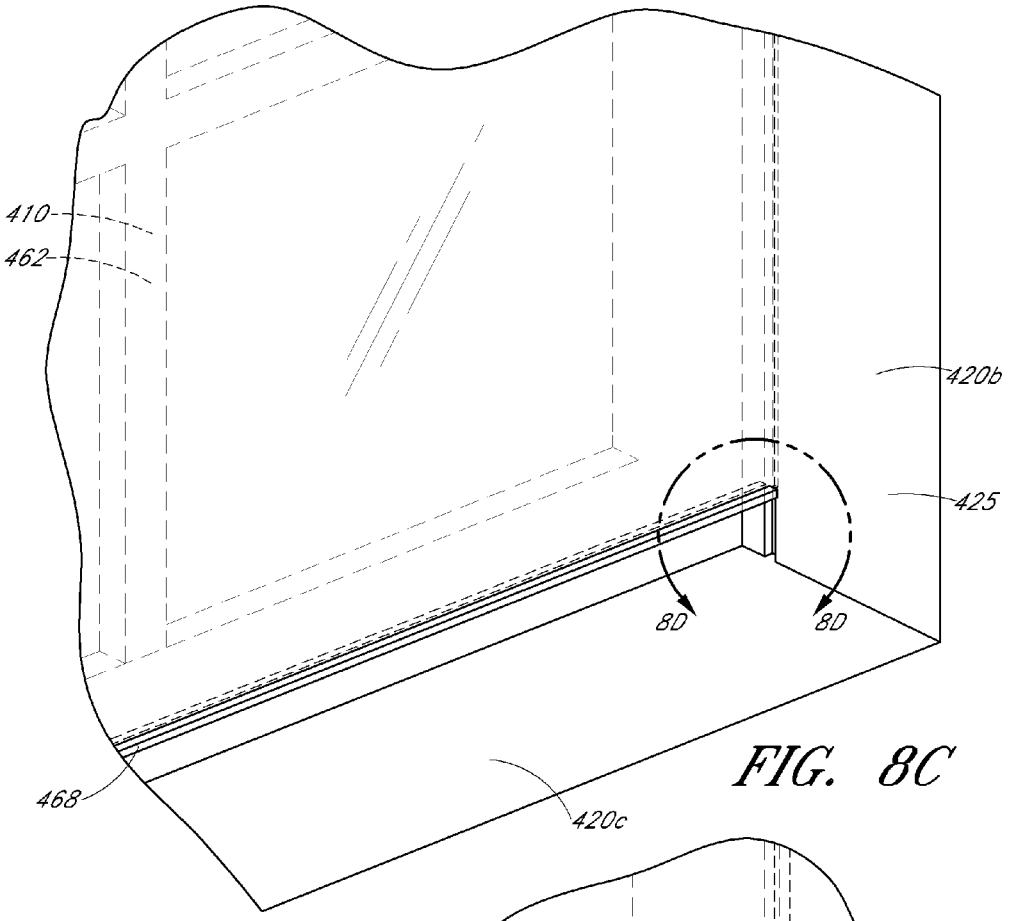
FIG. 8C is a perspective view of a portion of the window system of FIG. 8A.
Figure 8D:
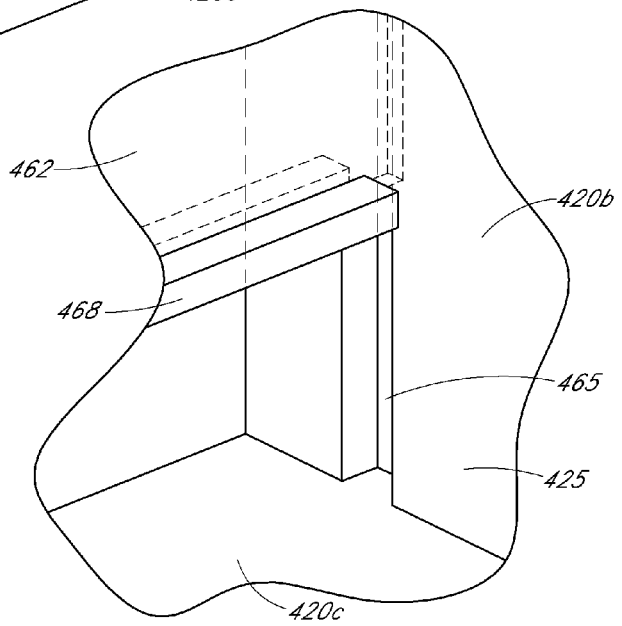
FIG. 8D is an enlarged perspective view of the window system of FIG. 8C taken along line 8D-8D.
Figure 8E:
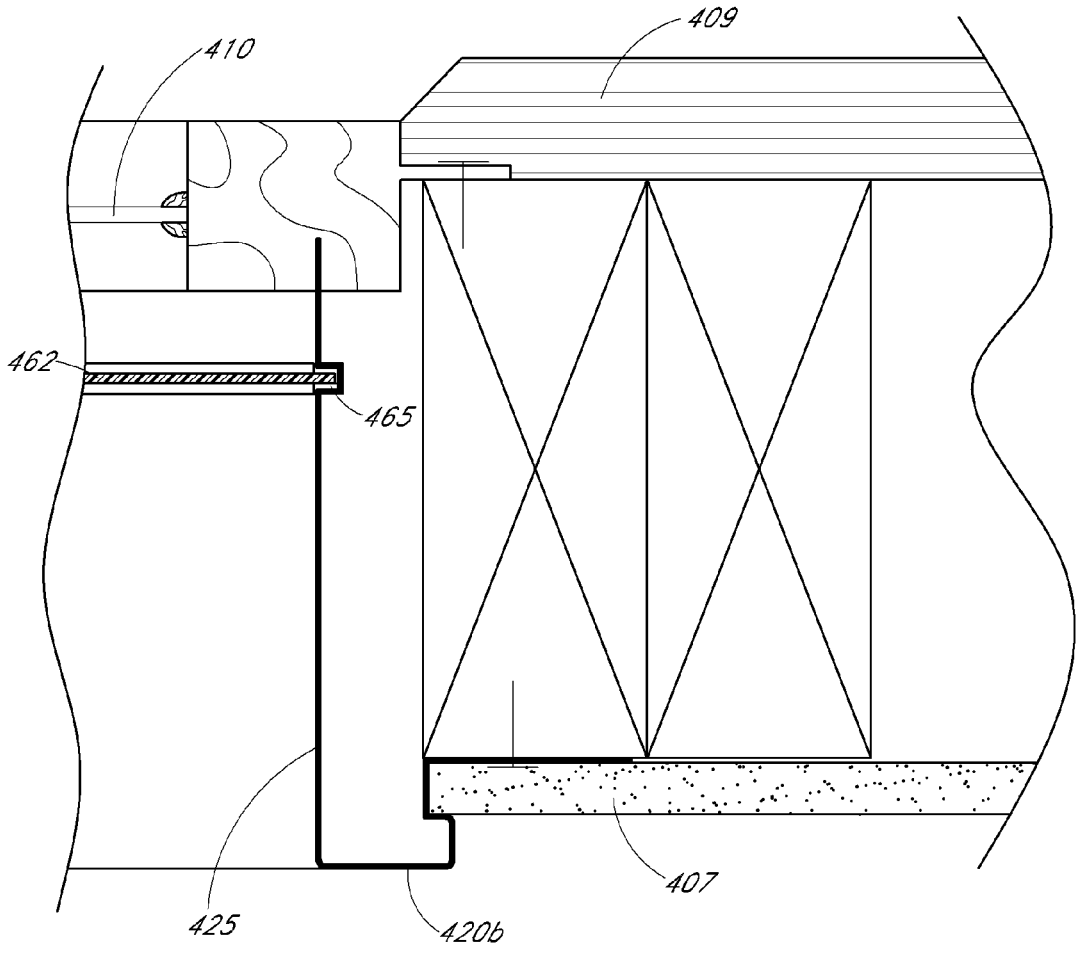
FIG. 8E is a vertical cross-sectional view of the window system of FIG. 8 taken along line 8E-8E.

Features of the inventive embodiments discussed herein can be employed in conjunction with other structures sometimes used in connection with windows. For example, in some embodiments reveal trim systems can be configured to accommodate a roll-up blind system. Yet another embodiment of a window system 1 is depicted in FIGS. 8-8E. As depicted in FIG. 8, blinds 462 can be deployed to occlude the window 10 (depicted in phantom behind the blinds 462). Advantageously, the blinds 462 can be provided in a manner such that their deployment-related components are hidden from view within a space 450, as depicted in FIGS. 8A and 8B. FIGS. 8A and 8B depict a space 450 between the upper reveal trim 420*a* and a header 2*a* that can be generally enlarged to house the blinds 462 and their corresponding structure. The reveal trims 420*b* on the sides of the window 10 and the reveal trim 420*c* at the bottom of the window can be configured to receive the blinds 462. For example, as discussed further below and depicted in FIGS. 8C-8E, the side reveal trims 420*b* can have a blind track 465 that receives edges of the blinds 462 as they proceed along the window 10.

The blinds 462 can be attached to a blind roll 460 that can rotate to either retract or deploy the blinds 462 to or from a position about the blind roll. The blinds 462 can pass through an opening 464 in the reveal trim 420*a* during the deployment and retraction. A blind end piece 468 can prevent the blinds 462 from exiting the opening 464, and can additional provide a ballast for the blinds 462. Further, a guide roller 466 can be provided to facilitate passage through the opening 464.

The blinds can be deployed and retracted in a variety of ways. In one embodiment, the blind roll 460 can be motorized to roll in both clockwise and counterclockwise directions to deploy or retract the blinds, and such motor can be provided within the space 450. In another embodiment, the blind roll 460 can be operated by hand via a variety of mechanisms known in the art.

The blind roll 460 and the guide roll 466 can mount within the space 450 in a variety of ways. In one embodiment, the rolls 460, 466 can mount directly to the building frame structure. In another embodiment, the rolls can mount to the upper reveal trim 420*a*. In yet another embodiment, the rolls 460, 466 can come in an independent housing that is then mounted within or to the upper trim 420*a* or the building frame structure.

As depicted in FIGS. 8A, 8B, the upper trim 420*a* can provide space 450 to accommodate the blinds 462. Further, in some embodiments this space 450 can be further increased by a cutout in the header 2*a*. Additionally, the side trims 420*b* can also differ, as depicted in FIGS. 8C-8E. As depicted, the blind track 465 in the side trims 420*b* is in the form of a groove along the reveal surface. The blinds 462 and the blind end 468 can pass through the blind tracks 465 on both ends such that the blinds 462 reliably span across the entire window frame 10, occluding the entire window about its periphery. The blind track 465 can also generally stabilize the blinds 462, to prevent undesired swaying under a breeze or other forces. Although not depicted as such here, in some embodiments the bottom trim 420*c* can also include a groove to receive the blinds 462 and the blind end 468, so as to provide a similarly complete span of the blinds 462 across the window frame 10 at its bottom. In some embodiments, the blind track 465 can have a depth of approximately 1 inch.

The embodiments with blinds 462 in FIGS. 8A-8E can vary in a number of ways. For example, the trims 420*a*-420*c* are depicted as going under the dry wall 7. However, in other embodiments they can go over the dry wall 7, as in the embodiments of FIGS. 1-4. Further, different combinations of trims 420 can be used, such as side trims without a groove 465. Even further, in some embodiments the groove 465 and the blind end 468 can have generally interlocking dove-tail shapes to further retain the blind end 468 within the groove 465.

As another example, in some embodiments the same principles can be used in conjunction with roll-up security doors. For example, the blinds 462 can be replaced by metal roll-up doors that proceed down the window 10 in a similar manner. The security doors can be accommodated, in some embodiments, by a roller container in the header 2*a* or by a larger space 450 between the header and the upper trim 420*a*. In other embodiments, the window system may lack an upper reveal trim 420*a*.

Figure 8F:
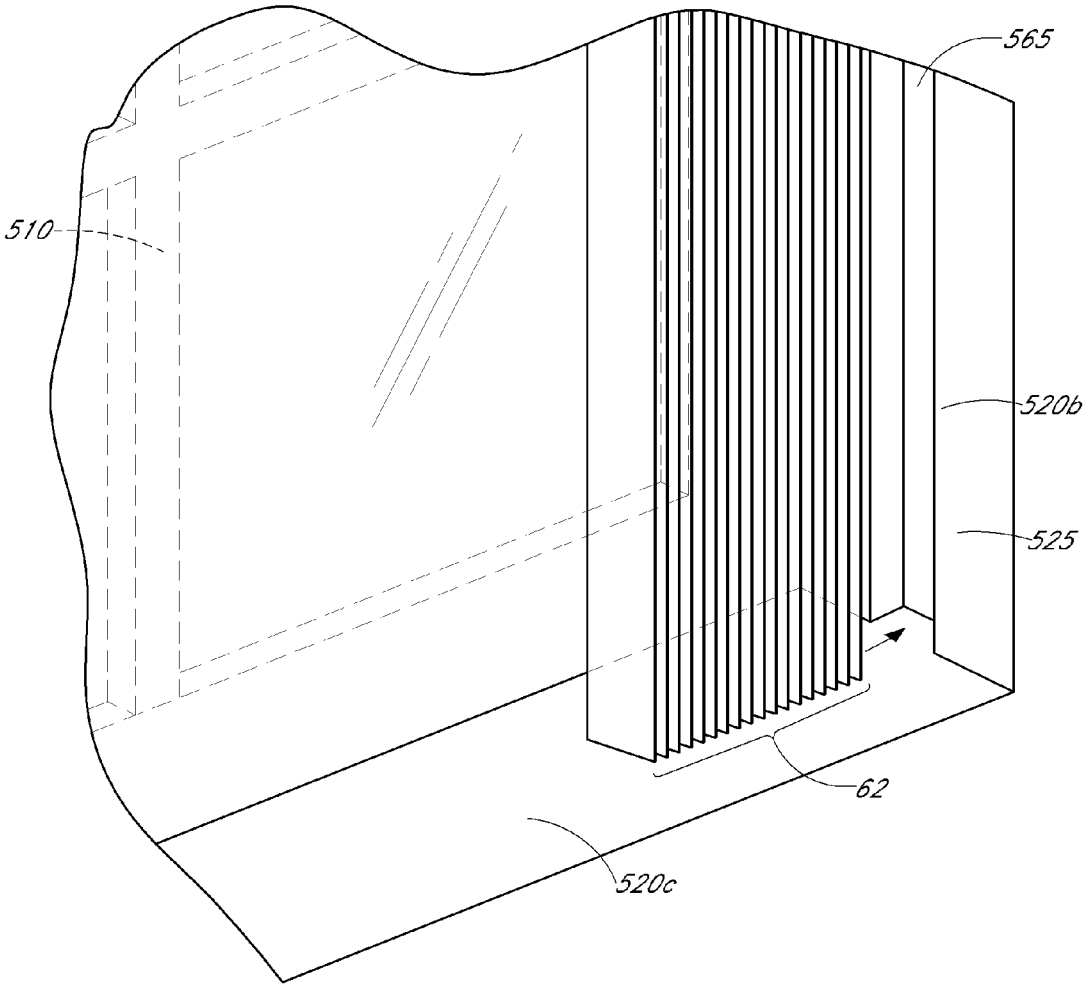
FIG. 8F is a perspective view of a portion of a window system resembling that of FIG. 8C, with vertical blinds.
Figure 8G:
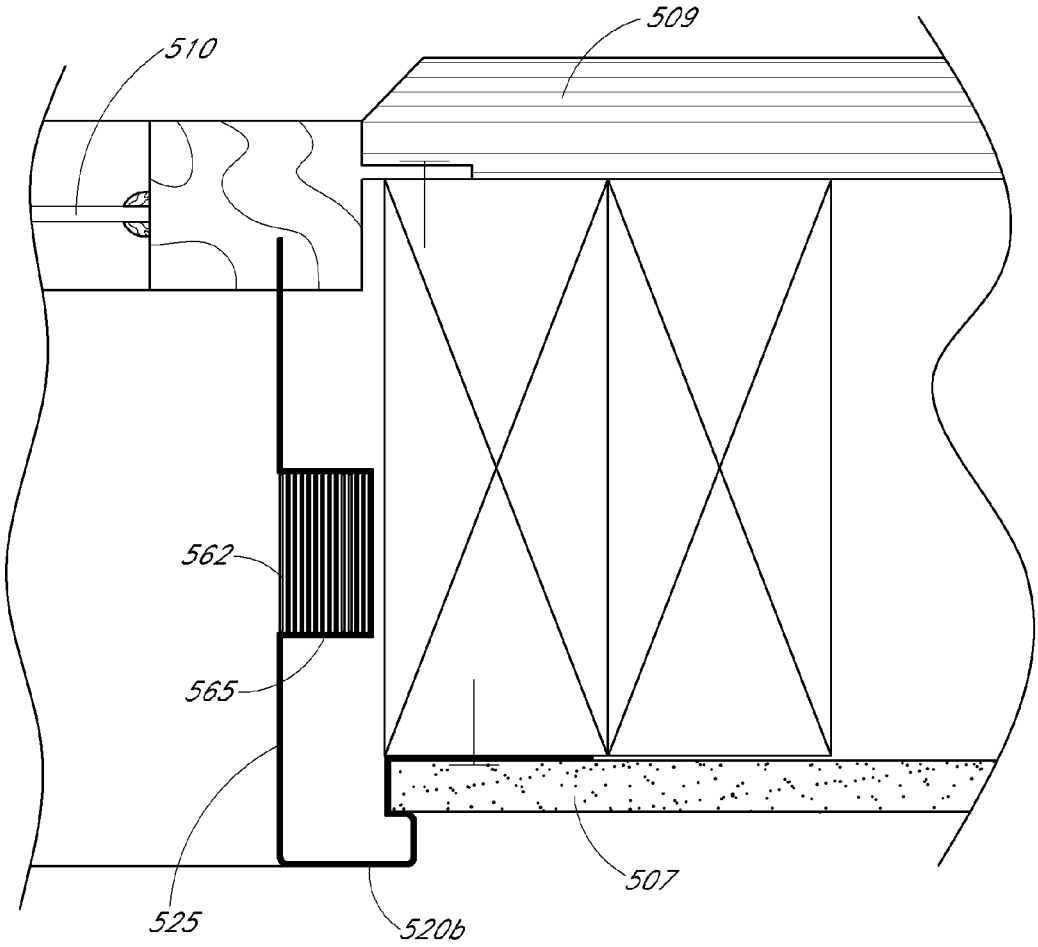
FIG. 8G is a vertical cross-sectional view of the window system of FIG. 8F resembling that of FIG. 8E.

As yet another example, in some embodiments similar principles can be used in conjunction with vertical blinds, as depicted in FIGS. 8F and 8G. As depicted, the vertical blinds 562 can retract into a side trim 520*b* with a side slot 565 similar to the blind track 465. Similar modifications can be made in the upper reveal trim 420*a* to accommodate a track for the vertical blinds, e.g. through a slot similar to the opening 464.

FIGS. 9A-9G depict additional alternative reveal trims also contemplated. FIG. 9 A depicts a trim 620*a* having structure similar to that of FIGS. 1-4, but having a bull nose corner.

Figure 9A:
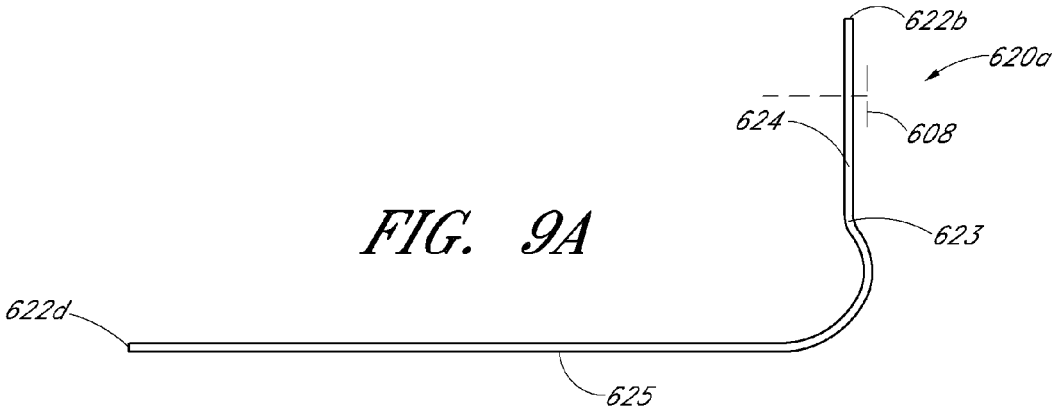
FIG. 9A is a side cross-sectional view of another embodiment of a reveal trim.
Figure 9B:
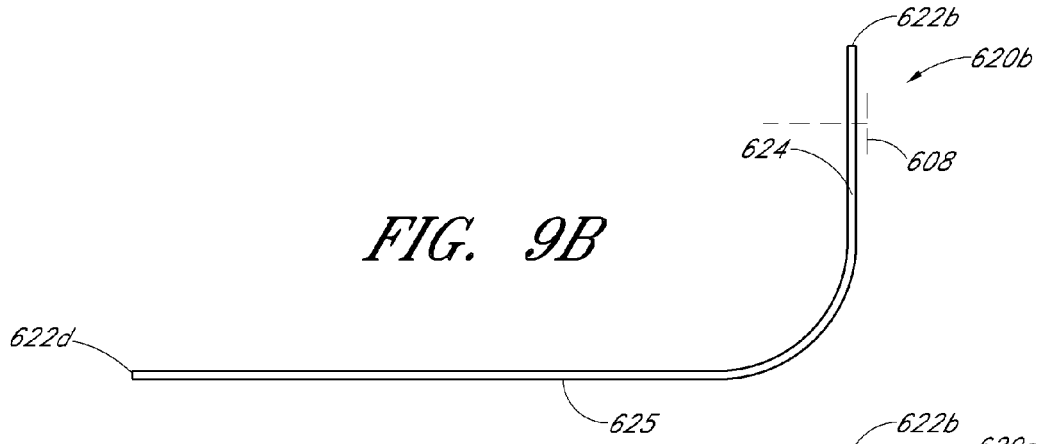
FIG. 9B is a side cross-sectional view of yet another embodiment of a reveal trim.

FIG. 9B depicts an embodiment of a reveal trim 620*b* substantially similar to that of FIG. 8 A, but without a recessed portion 623. In such an embodiment, the flange 627 can include a layer of adhesive and may be installed after finishing work on the wall members 7 has been completed.

Figure 9C:
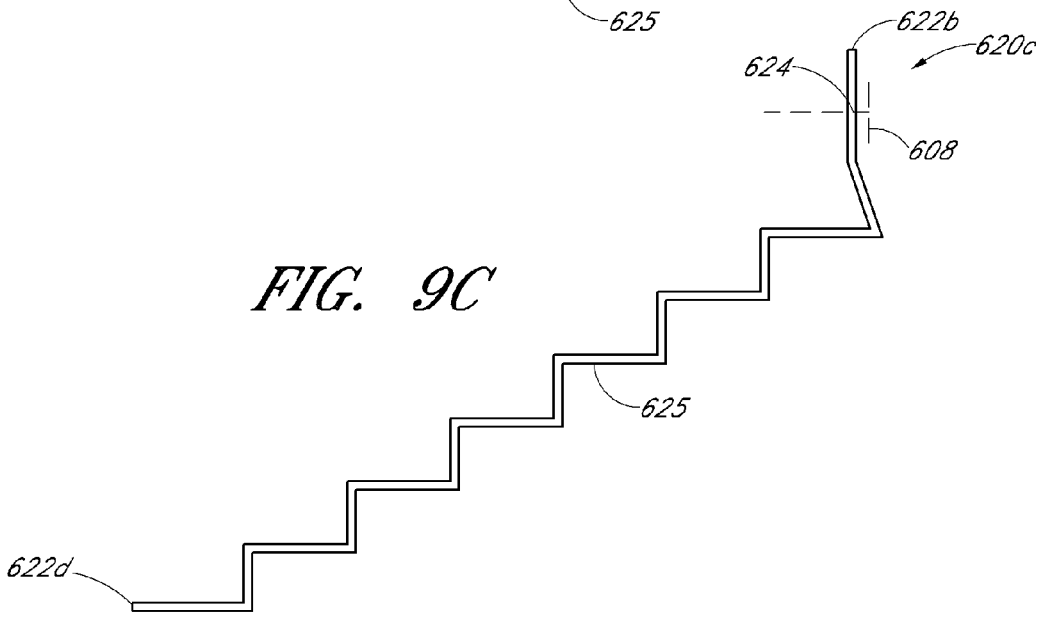
FIG. 9C is a side cross-sectional view of yet another embodiment of a reveal trim.

FIG. 9C depicts another embodiment of a reveal trim 620*c*. As depicted, the reveal trim 620*c* can have a reveal surface 625 with a plurality of steps in a stairs-like pattern.

Figure 9D:
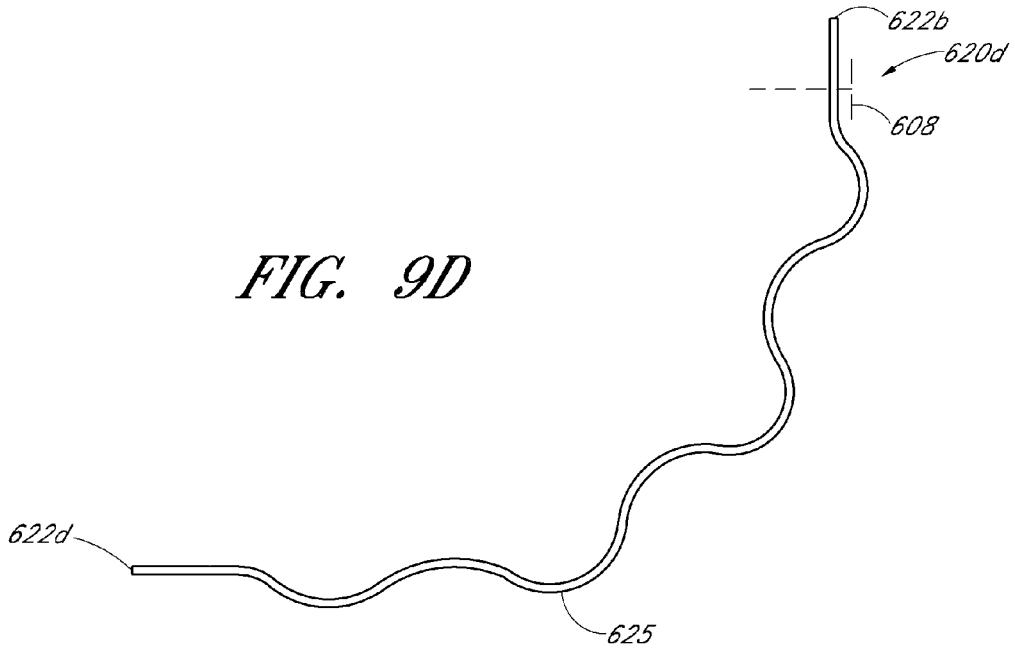
FIG. 9D is a side cross-sectional view of yet another embodiment of a reveal trim.

FIG. 9D depicts another embodiment of a reveal trim 620*d*. As depicted, the reveal trim 620*d* can have a reveal surface 625 with a plurality of curves.

Figure 9E:
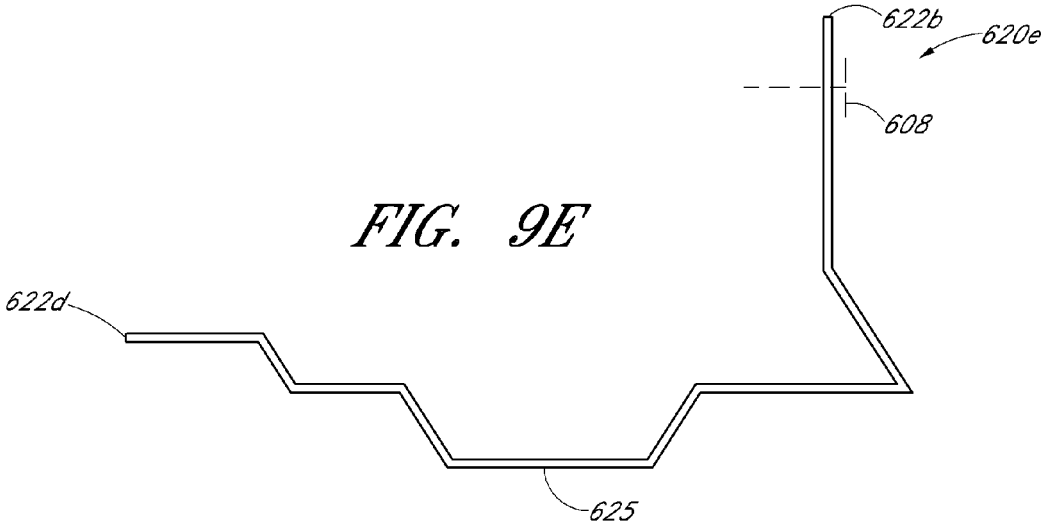
FIG. 9E is a side cross-sectional view of yet another embodiment of a reveal trim.

FIG. 9E depicts another embodiment of a reveal trim 620*e*. As depicted, the reveal trim 620*e* can have a reveal surface 625 with a plurality of angled steps in a pyramid-like arrangement.

Figure 9F:
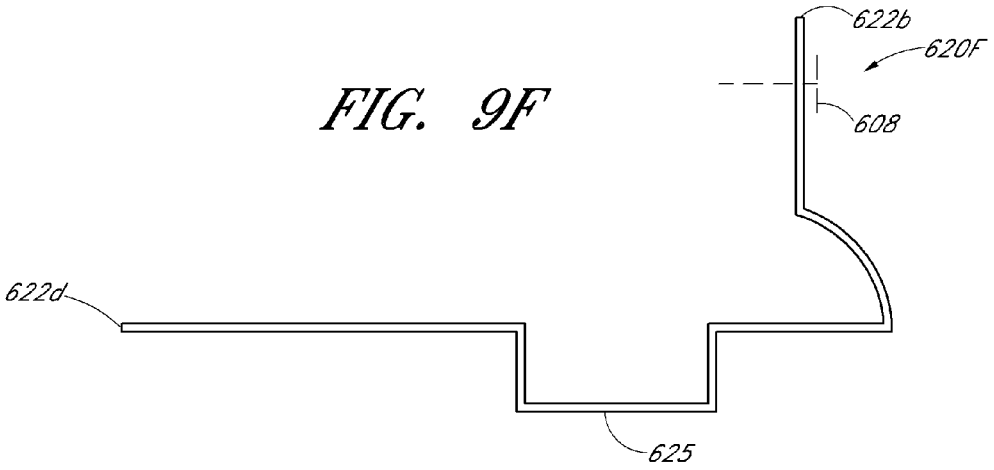
FIG. 9F is a side cross-sectional view of yet another embodiment of a reveal trim.

FIG. 9F depicts another embodiment of a reveal trim 620*f* As depicted, the reveal trim 620*f* can have a reveal surface 625 having a rectangular projection along its elongated portion. Additionally, the reveal trim 620*f* can have a reverse-bull nose corner.

Figure 9G:
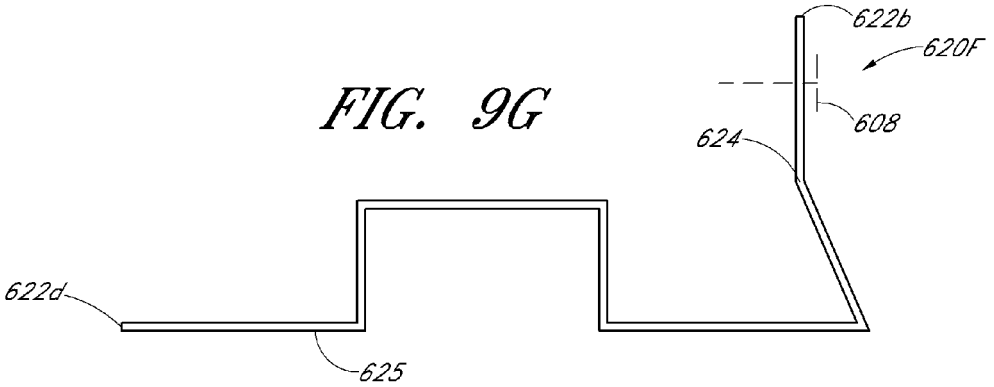
FIG. 9G is a side cross-sectional view of yet another embodiment of a reveal trim.

FIG. 9G depicts another embodiment of a reveal trim 620*g*. As depicted, the reveal trim 620*g* can have a rectangular cut-out along its elongated portion. It will be clear from the disclosure herein that a variety of corner designs are possible.

Advantageously, in some window frame systems the windows 10, trims 20, inserts 30, and blinds 62 (and their corresponding structure) can have coordinating sizes to provide substantial modularity. For example, in some embodiments the height and length of the window 10 and its slot grooves 12 can correspond with substantial precision to the manufactured lengths of the trims 20. In some embodiments, a plurality of windows, trims, and inserts can be manufactured with similar dimensions as described above. In other embodiments, they can be manufactured for a specific and uniquely shaped window, trim design, or insert design. The window 10 and matching trims 20 can then be advantageously provided together as a kit.

Similarly, in some embodiments the depth of the slot-grooves 12 can be predetermined, along with the length of the reveal trims 20 in a dimension extending into the slot-groove. Thus, the length of the trim 20 subtracted by the depth of the slot-groove 12 can indicate an available length of the trim. Similarly, these dimensions and the location of a hook 326 or a hook receiving portion on the trim 320 can indicate said elements distance from the window 10. The insert can then be dimensioned such that the length from its corresponding attachment structure to the window 10 is the same as that for the reveal trim 320, yielding a tight fit between the insert 330 and the window 10 when assembled. Similarly, the insert 330 can include a receiving portion that matches the extended portion 321 of the trim 320, providing a tight fit between the trim and insert at the second end.

In further embodiments, the trims 20 can be configured (along with the window 10 and its slot-groove 12) to accommodate particular sizes of structural elements. For example, as best depicted in FIG. 4A, the pieces can be sized so as to accommodate a two-by-four, two-by-six, or other size beam 2 between the stucco 9 and the dry wall 7. A predetermined width of the dry wall 7 can be assumed when sizing the reveal trim 20, slot-groove 12, and window 10.

The trims and inserts can be made from a variety of materials, including wood, metal, plastic, etc. However, other materials are possible.

In the illustrated embodiments, the reveal trims have been described having portions or ends that fit into elongate slots or grooves formed in window frames. As such, the slot on the window frame has been a female connector, or receiver, while the inserted end of the reveal trim has been a male connector, or projection. It is to be understood that other embodiments may employ features and concepts as discussed herein but employing differing structure. For example, in some embodiments, the window frame connector may be a projection that is received in a female connector formed on the reveal trim. Additionally, although the illustrated embodiments show an elongate, substantially straight slot that is generally parallel to an edge of the window frame and engages the reveal trim along its length, other embodiments are contemplated in which connectors of the window frame and reveal trims are discontinuous and/or directed in at least some portions in directions that are not necessarily parallel to an edge of the window frame.

The various devices, methods, procedures, and techniques described above provide a number of ways to carry out the invention. Of course, it is to be understood that not necessarily all objectives or advantages described may be achieved in accordance with any particular embodiment described herein. Also, although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. A method of forming a window reveal comprising:

providing a window mounted in an aperture formed in a building wall, the window having a frame having first through fourth elongated sides, each elongated side of the frame having an elongated slot formed therein;

providing first through fourth elongated reveal trims, each reveal trim having a face portion and a mount portion that are connected so that the reveal trim is generally L-shaped in cross section, wherein (1) each mount portion comprises one or more holes perpendicular to its long axis, through with a fastener can be inserted to secure the reveal trim to an adjacent section of the building wall; (2) on or more of the second, third and fourth reveal trims comprise insulation holes, through which insulation can be inserted between a section of the reveal trim and the window frame and/or adjacent section of the building wall when the reveal trim is engaged in the elongated slot; (3) the first reveal trim is configured to define an encloses space between the first reveal trim, the window frame and the adjacent section of the building wall when the face portion of the first reveal trim is inserted into the elongated slot on the uppermost side of the window frame and the mount portion is attached to an adjacent section of the building wall, and (4) the second and third reveal trims each comprise a vertical blind track;

inserting an edge of the face portions of the first through fourth elongated reveal trims into respective elongated frame slots of the first through fourth elongated sides so that the edge is held within the slot and the mount portion of the reveal trims cooperating to define a window reveal that is generally contiguous about the perimeter of the window;

attaching the mount portion of each reveal trim to respectively adjacent sections of the building wall;

inserting insulation foam through one or more insulation holes, and into the space between the reveal trim and the window frame and/or adjacent section of the building wall; and mounting a deployable blinds assembly within the enclosed space defined by the first reveal trim, wherein the blinds assembly is configured to deploy from the enclosed space and along the blind tracks to occlude the window.

2. The method of claim 1, wherein the fourth reveal trim comprises a groove configured to receive the blinds.

3. The method of claim 1, wherein the blinds comprise metal.

* * * * *